US007559631B2

(12) United States Patent
Shimada et al.

(10) Patent No.: US 7,559,631 B2
(45) Date of Patent: Jul. 14, 2009

(54) LIQUID-JET HEAD, METHOD FOR MANUFACTURING THE SAME, AND LIQUID-JET APPARATUS

(75) Inventors: Masato Shimada, Nagano-ken (JP); Shiro Yazaki, Nagano-ken (JP); Tsutomu Nishiwaki, Nagano-ken (JP); Akihito Tsuda, Nagano-ken (JP); Masataka Yamada, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 459 days.

(21) Appl. No.: 10/573,356

(22) PCT Filed: Sep. 24, 2004

(86) PCT No.: PCT/JP2004/013916

§ 371 (c)(1),
(2), (4) Date: Mar. 24, 2006

(87) PCT Pub. No.: WO2005/028207

PCT Pub. Date: Mar. 31, 2005

(65) Prior Publication Data

US 2006/0290747 A1 Dec. 28, 2006

(30) Foreign Application Priority Data

| | | |
|---|---|---|
| Sep. 24, 2003 | (JP) | 2003-332339 |
| Sep. 24, 2003 | (JP) | 2003-332340 |
| Oct. 23, 2003 | (JP) | 2003-363158 |
| Nov. 13, 2003 | (JP) | 2003-383916 |
| Dec. 17, 2003 | (JP) | 2003-419830 |

(51) Int. Cl.
*B41J 2/05* (2006.01)
*B41J 2/045* (2006.01)

(52) U.S. Cl. ..... 347/64; 347/71; 347/72

(58) Field of Classification Search ..... 347/68, 347/70, 71, 72, 64, 63, 54, 20, 56–59, 61–65, 347/67

See application file for complete search history.

(56) References Cited

U.S. PATENT DOCUMENTS

| | | | | |
|---|---|---|---|---|
| 5,594,482 | A * | 1/1997 | Ohashi | 347/69 |
| 6,033,058 | A * | 3/2000 | Usui et al. | 347/71 |
| 6,147,438 | A * | 11/2000 | Nishiwaki et al. | 310/363 |
| 6,260,960 | B1 | 7/2001 | Hashizume et al. | |
| 6,431,690 | B1 * | 8/2002 | Shinkai et al. | 347/68 |
| 6,502,928 | B1 * | 1/2003 | Shimada et al. | 347/68 |
| 6,505,919 | B1 | 1/2003 | Mizutani | |

(Continued)

FOREIGN PATENT DOCUMENTS

EP 612619 A1 * 8/1994

(Continued)

*Primary Examiner*—Rene Garcia, Jr.
(74) *Attorney, Agent, or Firm*—Sughrue Mion, PLLC

(57) ABSTRACT

A liquid-jet head and a manufacturing method thereof are provided. The liquid-jet head includes a channel substrate which has pressure generation chambers formed therein and communicating nozzle orifices for discharging liquid droplets, and piezoelectric elements. The piezoelectric element includes a lower electrode, a piezoelectric layer and an upper electrode, and disposed on one surface of the channel substrate via a vibration plate, wherein at least pattern regions of the respective layers which constitute the piezoelectric element are covered with an insulating film formed of an inorganic insulating material.

52 Claims, 22 Drawing Sheets

U.S. PATENT DOCUMENTS

| | | | | |
|---|---|---|---|---|
| 6,565,196 | B2 * | 5/2003 | Matsuo et al. | 347/68 |
| 6,609,785 | B2 * | 8/2003 | Hashizume et al. | 347/70 |
| 6,845,920 | B2 * | 1/2005 | Sato et al. | 239/102.1 |
| 6,943,485 | B2 | 9/2005 | Sumi | |
| 7,101,026 | B2 * | 9/2006 | Shimada et al. | 347/68 |
| 7,239,070 | B2 * | 7/2007 | Shimada et al. | 310/365 |
| 7,348,593 | B2 * | 3/2008 | Koo et al. | 257/40 |
| 7,364,273 | B2 * | 4/2008 | Takahashi | 347/68 |
| 2002/0080213 | A1 * | 6/2002 | Shimada et al. | 347/68 |
| 2003/0132991 | A1 * | 7/2003 | Higuchi et al. | 347/70 |
| 2006/0098058 | A1 * | 5/2006 | Yazaki | 347/72 |
| 2006/0209136 | A1 * | 9/2006 | Takahashi | 347/68 |

FOREIGN PATENT DOCUMENTS

| | | | |
|---|---|---|---|
| JP | 10173306 | A | 6/1998 |
| JP | 10-211701 | A | 8/1998 |
| JP | 10-226071 | A | 8/1998 |
| JP | 10-286960 | A | 10/1998 |
| JP | 11-077999 | A | 3/1999 |
| JP | 11-0777999 | A | 3/1999 |
| JP | 11-157067 | A | 6/1999 |
| JP | 11-157073 | A | 6/1999 |
| JP | 11-291493 | A | 10/1999 |
| JP | 2000-141644 | A | 5/2000 |
| JP | 2000-246896 | A | 9/2000 |
| JP | 2001203402 | A | 7/2001 |
| JP | 2001260348 | A | 9/2001 |
| JP | 2003-63000 | A | 3/2003 |
| JP | 2003-110160 | A | 4/2003 |
| JP | 2003197812 | A | 7/2003 |
| JP | 2003243736 | A | 8/2003 |

* cited by examiner (a)

(b)

(a)

(b)

(a)

(b)

(c)

(d)

(a)

(b)

(a)

(b)

(a)

(b)

(a)

(b)

(a)

(b)

LIQUID-JET HEAD, METHOD FOR MANUFACTURING THE SAME, AND LIQUID-JET APPARATUS

TECHNICAL FIELD

The present invention relates to a liquid-jet head and to a method for manufacturing the liquid-jet head, as well as to a liquid-jet apparatus. More particularly, the invention relates to an ink-jet recording head in which a vibration plate partially constitutes pressure generation chambers communicating with corresponding nozzle orifices for discharging ink droplets, piezoelectric elements are formed on the surface of the vibration plate, and displacement of the piezoelectric elements causes discharge of ink droplets, and to a method for manufacturing the ink-jet recording head, as well as to an ink-jet recording apparatus.

BACKGROUND ART

Ink-jet recording heads which have been put into practical use include two kinds in which a vibration plate partially constitutes pressure generation chambers communicating with corresponding nozzle orifices for discharging ink droplets, and piezoelectric elements cause the vibration plate to be deformed so as to apply pressure to ink contained in the corresponding pressure generation chambers to thereby discharge ink droplets from corresponding nozzle orifices. One such kind of ink-jet recording head uses piezoelectric actuators that operate in the longitudinal vibration mode; i.e., piezoelectric actuators that extend and contract in the axial direction of the piezoelectric elements. The other kind of ink-jet recording head uses piezoelectric actuators that operate in the flexural vibration mode.

The former recording head has an advantage in that a function for changing the volume of a pressure generation chamber can be implemented through an end face of a piezoelectric element abutting a vibration plate, thereby exhibiting good suitability to high-density printing. However, the former recording head has a drawback in that a fabrication process is complicated; specifically, fabrication involves a difficult process of dividing the piezoelectric element into comb-tooth-like segments at intervals corresponding to those at which nozzle orifices are arranged, as well as a process of fixing the piezoelectric segments in such a manner as to be aligned with corresponding pressure generation chambers.

The latter recording head has an advantage in that piezoelectric elements can be formed on a vibration plate through a relatively simple process; specifically, a green sheet of piezoelectric material is overlaid on the vibration plate in such a manner as to correspond in shape and position to a pressure generation chamber, followed by firing. However, the latter recording head has a drawback in that a piezoelectric element requires a certain area in order to utilize flexural vibration, thus involving difficulty in arranging piezoelectric elements in high density.

In order to solve the drawback of the latter recording head, there has been proposed an ink-jet recording head in which an even layer of piezoelectric material is formed over the entire surface of a vibration plate by use of a film deposition technique, and by means of lithography, the layer of piezoelectric material is divided in such a manner as to correspond in shape and position to pressure generation chambers, thereby forming independent piezoelectric elements corresponding to the pressure generation chambers. Piezoelectric elements formed in such a manner have a problem in that they are easily broken because of, for example, characteristics of the external environment such as moisture. In order to solve this problem, there has been proposed an ink-jet recording head in which a sealing substrate (reservoir-forming substrate) having a piezoelectric-element-holding portion is joined to a channel substrate in which pressure generation chambers are formed, and piezoelectric elements are sealed within the piezoelectric-element-holding portion (see, for example, Patent Document 1).

However, even in the case where piezoelectric elements are sealed in this manner, there arises a problem in that when water enters the piezoelectric-element-holding portion through a bonding portion between the sealing substrate and the channel substrate, the quantity of moisture within the piezoelectric-element-holding portion gradually increases, and finally, the piezoelectric elements are broken because of the moisture.

Further, in order to solve the problem of the piezoelectric elements being easily broken under the influence of the external environment, there has been proposed an ink-jet recording head in which a thin insulating layer formed of silicon oxide, nitrogen oxide, or an organic material, preferably, a photosensitive polyimide, is formed to cover at least a peripheral edge of the upper surface of the upper electrode of each piezoelectric element, and a side surface of the piezoelectric layer thereof, and conductive patterns (lead electrodes) are formed on the insulating layer (see, for example, Patent Document 2).

This configuration can prevent permeation of water into piezoelectric elements to some degree. However, since the conductive patterns are exposed, water may penetrate through a window where a conductive pattern is connected to a corresponding upper electrode. Therefore, breakage of piezoelectric elements due to water cannot be prevented completely.

Further, in order to solve the problem of the piezoelectric elements being easily broken under the influence of the external environment, there has been proposed an ink-jet recording head in which the piezoelectric elements are entirely covered with a protective film formed of an organic material whose Young's modulus of elasticity is smaller than that of the piezoelectric layer; e.g., polyimide (see, for example, Patent Document 3). This structure can prevent breakage of piezoelectric elements. However, since the stress produced in the protective film formed of the above-described material is typically tensile stress, when piezoelectric elements are covered with such a protective film, there arises a problem in that compression force acts on the piezoelectric elements (piezoelectric layer), and the amount of displacement of the vibration plate caused through drive of a piezoelectric element drops. Further, the protective film formed of an organic material cannot prevent permeation of water unless it has a considerably large thickness. However, the large thickness may become an influential factor which hinders drive of the piezoelectric elements.

The above-described problems arise not only in ink-jet recording heads which discharge ink droplets, but also in liquid-jet heads which discharge droplets of liquid other than ink.

Patent Document 1: Japanese Patent Application Laid-Open (kokai) No. 2003-136734 (FIGS. 1, 2, and page 5)

Patent Document 2: Japanese Patent Application Laid-Open (kokai) No. H10-226071 (FIG. 2, and paragraph [0015])

Patent Document 3: Japanese Patent Application Laid-Open (kokai) No. 2003-110160 (claims and FIG. 5)

DISCLOSURE OF THE INVENTION

Problems to be Solved by the Invention

In view of the foregoing, an object of the present invention is to provide a liquid-jet head which can reliably prevent breakage of piezoelectric elements over a long period of time, and a method for manufacturing the liquid-jet head, as well as a liquid-jet apparatus. Another object of the present invention is to provide a liquid-jet head which can effectively prevent a drop in the amount of displacement of a vibration plate caused through drive of a piezoelectric element, and a method for manufacturing the liquid-jet head, as well as a liquid-jet apparatus.

Means for Solving the Problems

A first aspect of the present invention which solves the above-described problems is a liquid-jet head characterized by comprising a channel substrate which has pressure generation chambers formed therein and communicating nozzle orifices for discharging liquid droplets; and piezoelectric elements each of which is composed of a lower electrode, a piezoelectric layer, and an upper electrode and which are disposed on one surface of the channel substrate via a vibration plate, wherein at least pattern regions of the respective layers which constitute the piezoelectric elements are covered with an insulating film formed of an inorganic insulating material.

In the first aspect, since the piezoelectric layer is covered with an insulating film formed of an inorganic insulating material, which has a low water permeability, deterioration (breakage) of the piezoelectric elements under influence of the external environment such as water (moisture) can be prevented reliably over a long period of time, without greatly hindering the drive of the piezoelectric elements.

A second aspect of the present invention is the liquid-jet head according to the first aspect, wherein the insulating film is formed of an amorphous material.

In the second aspect, an insulating film having a low water permeability can be formed. Therefore, even when the insulating film is formed to have a relatively small thickness, breakage of the piezoelectric elements under influence of the external environment such as water can be reliably prevented.

A third aspect of the present invention is the liquid-jet head according to the second aspect, wherein the amorphous material is aluminum oxide ($Al_2O_3$).

In the third aspect, the piezoelectric elements are covered with an insulating film formed of $Al_2O_3$ whose water permeability is considerably low among various inorganic insulating materials. Therefore, breakage of the piezoelectric elements under influence of the external environment such as water can be reliably prevented, without greatly hindering the drive of the piezoelectric elements.

A fourth aspect of the present invention is the liquid-jet head according to the third aspect, wherein the insulating film has a thickness of 30 to 150 nm.

In the fourth aspect, breakage of the piezoelectric elements under influence of the external environment such as water can be reliably prevented, while displacement of the piezoelectric elements can be secured.

A fifth aspect of the present invention is the liquid-jet head according to the third or fourth aspect, wherein the insulating film has a film density of 3.08 to 3.25 g/cm$^3$.

In the fifth aspect, the adhesive properties of the insulating film can be improved. Therefore, breakage of the piezoelectric elements under influence of the external environment such as water can be reliably prevented, and displacement of the piezoelectric elements can be secured.

A sixth aspect of the present invention is the liquid-jet head according to any one of the third to fifth aspects, wherein the insulating film has a Young's modulus of elasticity of 170 to 200 GPa.

In the sixth aspect, breakage of the piezoelectric elements under influence of the external environment such as water can be prevented, and displacement of the piezoelectric elements can be secured.

A seventh aspect of the present invention is the liquid-jet head according to any one of the third to sixth aspects, wherein a lead electrode for the upper electrode is formed of a material containing aluminum as a predominant component.

In the seventh aspect, the adhesion between the leads and the insulating film is improved, whereby the ratio of water permeating to the piezoelectric layer can be reduced further. Therefore, for example, breakage of the leads or defective connection with drive wiring can be prevented.

An eighth aspect of the present invention is the liquid-jet head according to any one of the first to seventh aspects, wherein the sum of stress of the insulating film and stress of the upper electrode is compressive.

In the eighth aspect, since the piezoelectric elements are covered with an insulating film, deterioration (breakage) of the piezoelectric layer under influence of the external environment such as water (moisture) can be reliably prevented over a long period of time. Further, since the sum of stress of the insulating film and stress of the upper electrode is compressive, the deflection of the vibration plate is reduced, and a decrease in amount of displacement of the vibration plate can be effectively prevented.

A ninth aspect of the present invention is the liquid-jet head according to the eighth aspect, wherein stress of the insulating film and stress of the upper electrode are each compressive.

In the ninth aspect, the sum of stress of the insulating film and stress of the upper electrode can be made compressive in a relatively easy manner.

A tenth aspect of the present invention is the liquid-jet head according to the ninth aspect, wherein the upper electrode is formed of at least Ir.

In the tenth aspect, since at least Ir is used as a material for the upper electrode, stress of the upper electrode becomes compressive.

An eleventh aspect of the present invention is the liquid-jet head according to the eighth aspect, wherein stress of the insulating film is compressive, and stress of the upper electrode is tensile.

In the eleventh aspect, since the sum of stress of the insulating film and stress of the upper electrode is compressive, the deflection of the vibration plate is reduced, and a decrease in amount of displacement of the vibration plate can be effectively prevented.

A twelfth aspect of the present invention is the liquid-jet head according to the eleventh aspect, wherein the upper electrode is formed of at least Pt.

In the twelfth aspect, since at least Pt is used as a material for the upper electrode, stress of the upper electrode becomes tensile.

A thirteenth aspect of the present invention is the liquid-jet head according to the eleventh or twelfth aspect, wherein stress a of the upper electrode and that of the insulating film are each represented by the product ($\epsilon \times Y \times m$) of Young's modulus of elasticity Y, distortion $\epsilon$, and film thickness m, and stress $\sigma_1$ of the upper electrode and stress $\sigma_2$ of the insulating film satisfy the condition $|\sigma_1|<|\sigma_2|$.

In the thirteenth aspect, since the sum of stress of the insulating film and stress of the upper electrode is compressive, the deflection of the vibration plate is reduced, and a decrease in amount of displacement of the vibration plate can be prevented effectively.

A fourteenth aspect of the present invention is the liquid-jet head according to any one of the first to thirteenth aspects, wherein an upper-electrode lead electrode extending from the upper electrode is further provided, and at least pattern regions of the respective layers which constitute the piezoelectric elements and the upper-electrode lead electrode are covered with the insulating film, except for regions facing connection portions of the lower electrode and the upper-electrode lead electrode, the connection portions being used for connection with connection wiring.

In the fourteenth aspect, since the pattern region of the upper-electrode lead electrode, together with the piezoelectric elements, is covered with an insulating film formed of an inorganic insulating material, which has a low water permeability, deterioration (breakage) of the piezoelectric layer (piezoelectric elements) due to water (moisture) can be reliably prevented over a long period of time.

A fifteenth aspect of the present invention is the liquid-jet head according to the fourteenth aspect, wherein a lower-electrode lead electrode extending from the lower electrode is further provided, the lower electrode is connected to the connection wiring via the lower-electrode lead electrode, and the pattern region containing the lower-electrode lead electrode is covered with the insulating film, except for regions of the upper-electrode lead electrode and the lower-electrode lead electrode facing the connection wiring.

In the fifteenth aspect, since the lower-electrode lead electrode is covered with the insulating film formed of an inorganic insulating material, permeation of water to the piezoelectric elements can be more reliably prevented.

A sixteenth aspect of the present invention is the liquid-jet head according to the fourteenth or fifteenth aspect, wherein the upper electrode and the upper-electrode lead electrode are formed of different materials.

In the sixteenth aspect, since the upper electrode and the upper-electrode lead electrode are formed in different processes, the thickness of the upper electrode can be reduced easily. Further, as a result of decreasing the thickness of the upper electrode, the amount of displacement of the piezoelectric layer increases.

A seventeenth aspect of the present invention is the liquid-jet head according to any one of the first to sixteenth aspects, wherein the piezoelectric layer and the upper electrode of each piezoelectric element extend to the outside of a region facing the corresponding pressure generation chamber so that a piezoelectric non-active portion is formed, and an end portion of the upper-electrode lead electrode on the side toward the upper electrode is located on the piezoelectric non-active portion and outside the pressure generation chamber.

In the seventeenth aspect, it is possible to prevent generation of cracks or the like in the piezoelectric element, which would otherwise be generated when the piezoelectric element is driven, because of generation of noncontiguous stress in a region facing the end portion of the pressure generation chamber.

An eighteenth aspect of the present invention is the liquid-jet head according to any one of the first to seventeenth aspects, wherein in a state in which the connection wiring is connected, the connection portions are covered with a sealing material formed of an organic insulating material.

In the eighteenth aspect, since permeation of water from the exposed portions is prevented, breakage of the piezoelectric layer can more reliably prevented.

A nineteenth aspect of the present invention is the liquid-jet head according to any one of the fourteenth to eighteenth aspects, wherein the insulating film includes a first insulating film and a second insulating film, the piezoelectric elements are covered by the first insulating film except for the connection portion for connection with the upper-electrode lead electrode, the upper-electrode lead electrode is provided on the first insulating film, and at least the pattern regions of the respective layers which constitute the piezoelectric elements and the upper-electrode lead electrode are covered with the second insulating film except for regions facing the connection portions.

In the nineteenth aspect, since permeation of water to the piezoelectric layer is reliably prevented by the first and second insulating films, deterioration (breakage) of the piezoelectric layer (piezoelectric elements) due to water (moisture) can be reliably prevented over a long period of time.

A twentieth aspect of the present invention is the liquid-jet head according to any one of the fourteenth to nineteenth aspects, wherein the connection wiring includes a second upper-electrode lead electrode extending from the upper-electrode lead electrode, the second upper-electrode lead electrode is provided on the insulating film and is connected to the upper-electrode lead electrode at the connection portion, and a terminal portion to which drive wring is connected is provided at a tip end portion of the second upper-electrode lead electrode.

In the twentieth aspect, since the piezoelectric layer is covered with the insulating film formed of an inorganic insulating material having a low water permeability, and the insulating film is continuously provided to enter under the terminal portion. Therefore, even when water (moisture) enters under the insulating film, water is more reliably prevented from coming into contact with the piezoelectric layer. Accordingly, deterioration (breakage) of the piezoelectric layer (piezoelectric elements) due to water (moisture) can be reliably prevented over a long period of time.

A twenty-first aspect of the present invention is the liquid-jet head according to any one of the fourteenth to twentieth aspect, wherein the piezoelectric layer and the upper electrode of each piezoelectric element extend to the outside of a region facing the corresponding pressure generation chamber so that a piezoelectric non-active portion is formed, and an upper-electrode-side end portion of the upper-electrode lead electrode which is connected to the upper electrode is located on the piezoelectric non-active portion and outside the pressure generation chamber.

In the twenty-first aspect, it is possible to prevent generation of cracks or the like in the piezoelectric element, which would otherwise be generated when the piezoelectric element is driven, because of generation of noncontiguous stress in a region facing the end portion of the pressure generation chamber.

A twenty-second aspect of the present invention is the liquid-jet head according to any one of the fourteenth to twenty-first aspects, wherein a protective plate having a piezoelectric-element-holding portion, which is a space for protecting the piezoelectric elements, is bonded to a surface of the channel substrate, the surface being located on the side toward the piezoelectric elements, and the connection portion of the upper-electrode lead electrode is provided outside the piezoelectric-element-holding portion.

In the twenty-second aspect, since the protective plate is bonded to the insulating film in a state in which the connection portion is provided outside the piezoelectric-element-holding portion, the bonding strength of the protective plate increases.

A twenty-third aspect of the present invention is the liquid-jet head according to any one of the first to twenty-second aspects, wherein a protective plate having a piezoelectric-element-holding portion, which is a space for protecting the piezoelectric elements, is bonded to a surface of the channel substrate, the surface being located on the side toward the piezoelectric elements, the protective plate includes a flow passage for liquid to be supplied to the pressure generation chambers, the adhesive layer located on the flow passage side of the piezoelectric-element-holding portion is exposed to the interior of the flow passage, and a moisture permeable portion which enables permeation of water within the piezoelectric-element-holding portion is provided in a region located other than the flow passage side of the piezoelectric-element-holding portion.

In the twenty-third aspect, since water (moisture) having permeated from the flow passage to the piezoelectric-element-holding portion via the adhesive layer is discharged to the outside via the moisture permeable portion, the humidity within the piezoelectric-element-holding portion is maintained at least at a level close to the humidity of the outside air. Since the piezoelectric elements are covered with the insulating film, if the humidity within the piezoelectric-element-holding portion is maintained at a level close to the humidity of outside air, breakage of the piezoelectric elements due to water (moisture) can be prevented.

A twenty-fourth aspect of the present invention is the liquid-jet head according to the twenty-third aspect, wherein the moisture permeable portion is formed of an organic material.

In the twenty-fourth aspect, since the moisture permeable portion is formed of an organic material, which is a material having a high water permeability, water within the piezoelectric-element-holding portion can be effectively discharged.

A twenty-fifth aspect of the present invention is the liquid-jet head according to the twenty-third or twenty-fourth aspects, wherein the moisture permeable portion is provided on a portion of a bonding surface of the protective plate, the bonding surface being bonded to the channel substrate.

In the twenty-fifth aspect, the moisture permeable portion can be formed in a relatively easy manner.

A twenty-sixth aspect of the present invention is the liquid-jet head according to the twenty-third or twenty-fourth aspects, wherein the moisture permeable portion is provided on an upper surface of the protective plate.

In the twenty-sixth aspect, the moisture permeable portion can be formed in a relatively easy manner.

A twenty-seventh aspect of the present invention is the liquid-jet head according to the twenty-fifth or twenty-sixth aspects, wherein the moisture permeable portion is formed of an adhesive having a water permeability higher than that of an adhesive which constitutes the adhesive layer.

In the twenty-seventh aspect, since the channel substrate and the protective plate are bonded together by the adhesive layer and the moisture permeable portion, the bonding strength increases.

A twenty-eighth aspect of the present invention is the liquid-jet head according to any one of the twenty-third to twenty-sixth aspects, wherein the moisture permeable portion is formed of a potting material.

In the twenty-eighth aspect, the moisture permeable portion can be easily formed, and the moisture permeable has a high water permeability.

A twenty-ninth aspect of the present invention is the liquid-jet head according to any one of the twenty-third to twenty-eighth aspect, wherein the moisture permeable portion is provided in a region on a side of the piezoelectric-element-holding portion opposite the flow passage.

In the twenty-ninth aspect, water within the flow passage does not permeate via the moisture permeable portion, and water within the piezoelectric-element-holding portion is discharged effectively via the moisture permeable portion.

A thirtieth aspect of the present invention is the liquid-jet head according to the twenty-third or twenty-fourth aspects, wherein the moisture permeable portion is provided on the protective plate in each of the regions outside the opposite ends of the row of pressure generation chambers.

In the thirtieth aspect, breakage of the piezoelectric elements due to water can be prevented over a long period of time.

A thirty-first aspect of the present invention is a liquid-jet apparatus characterized by comprising the liquid-jet head according to any one of the first to thirtieth aspects.

In the thirty-first aspect, a liquid-jet apparatus having improved durability and reliability is realized.

A thirty-second aspect of the present invention is a method of manufacturing a liquid-jet head, comprising the steps of forming piezoelectric elements, each of which is composed of a lower electrode, a piezoelectric layer, and an upper electrode, on one surface of a channel substrate via a vibration plate, the channel substrate having pressure generation chambers formed therein and communicating nozzle orifices for discharging liquid droplets; forming an upper-electrode lead electrode extending from the upper electrode of each piezoelectric element; forming an insulating film of an inorganic insulating material over the entirety of a surface of the channel substrate, the surface facing the piezoelectric elements; and patterning the insulating film such that at least connection-wiring connection portions of the lower electrode and the upper-electrode lead electrode are exposed, and the insulating film is left in pattern regions of the respective layers of the piezoelectric elements and the upper-electrode lead electrode, except for the connection portion.

In the thirty-second aspect, the insulating film can be formed properly within the pattern regions of the piezoelectric elements and the upper-electrode lead electrode, except for the connection portion.

A thirty-third aspect of the present invention is the method of manufacturing a liquid-jet head according to the thirty-second aspect, wherein in the step of patterning the insulating film, a portion of the insulating film within a predetermined region is removed by means of ion milling.

In the thirty-third aspect, the insulating film can be removed well with high dimensional accuracy.

A thirty-fourth aspect of the present invention is the method of manufacturing a liquid-jet head according to the thirty-second or thirty-third aspect, wherein the method includes, after the step of patterning the insulating film, a step of bonding a protective plate to a surface of the channel substrate, the surface facing the piezoelectric elements, the protective plate including a piezoelectric-element-holding portion for protecting the piezoelectric elements and a flow passage for liquid to be supplied to the pressure generation chambers, wherein in the step of bonding the protective plate, an adhesive is applied to the protective plate such that a space portion is left in a portion of a region surrounding the piezoelectric-element-holding portion, except for a region located on the side toward the flow passage, the protective plate is bonded to the channel substrate, and the space portion is sealed by a material having a water permeability higher than that of the adhesive so as to form a moisture permeable portion through which water within the piezoelectric-element-holding portion permeates.

In the thirty-fourth aspect, the moisture permeable portion can be easily formed without making the production process complicated.

DESCRIPTION OF REFERENCE NUMERALS

10 channel substrate; 12 pressure generation chamber; 20 nozzle plate; 21 nozzle orifice; 30 protective plate; 31 piezoelectric-element-holding portion; 32 reservoir section; 33 through-hole; 35 adhesive; 40 compliance substrate; 50 elastic film; 55 insulating film; 60 lower electrode film; 70 piezoelectric layer; 80 upper electrode film; 90, 90A lead electrodes for upper electrodes; 90*a* connection portion; 100 insulating film; 110 reservoir; 120 drive IC; 130 connection wiring; 140 sealing material; 300 piezoelectric element; 330 piezoelectric non-active portion

BEST MODE FOR CARRYING OUT THE INVENTION

The present invention will next be described in detail by way of embodiments.

EMBODIMENT 1

Figure 1:
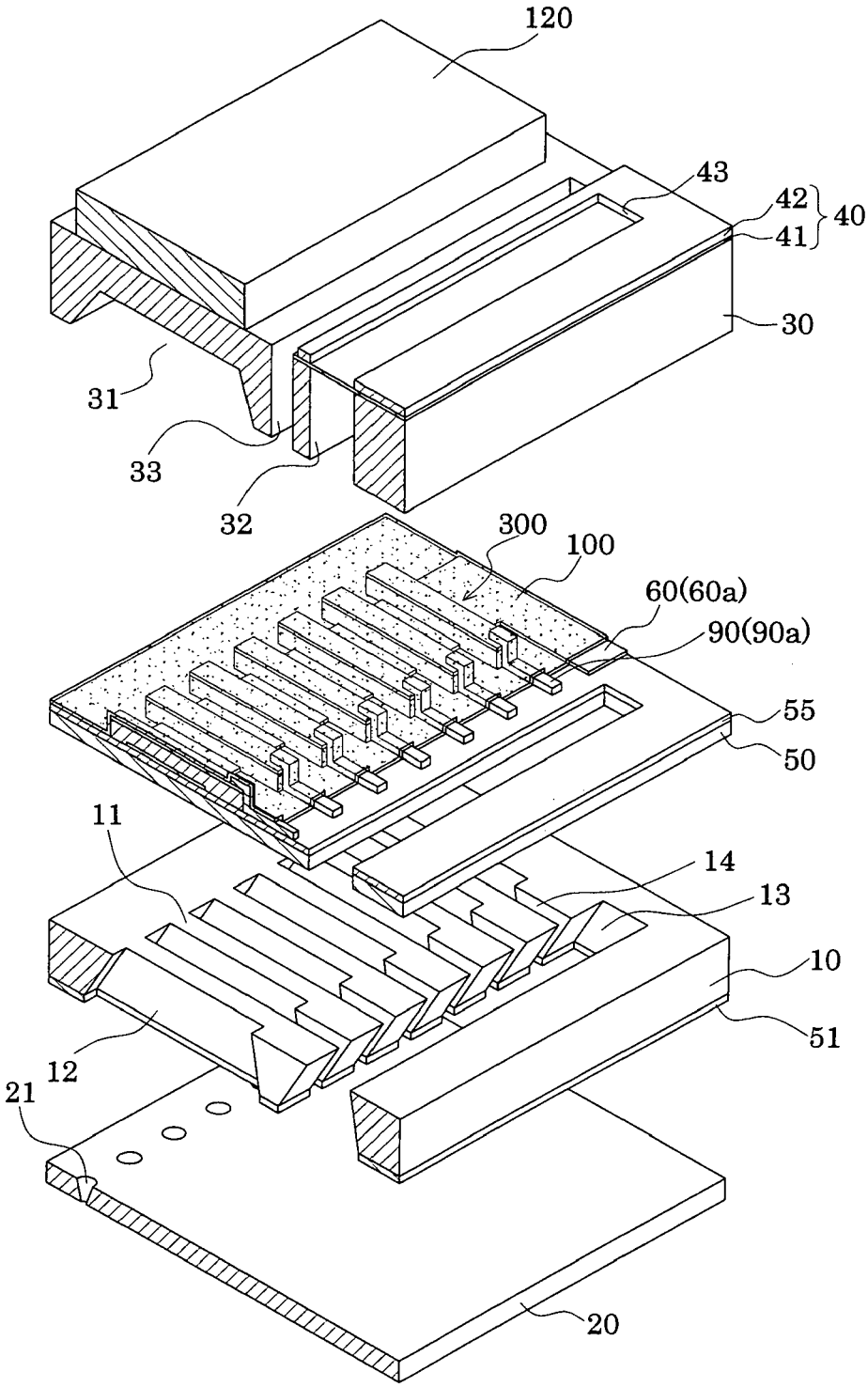
FIG. 1 is a schematic perspective view of a recording head according to Embodiment 1.
Figure 2:
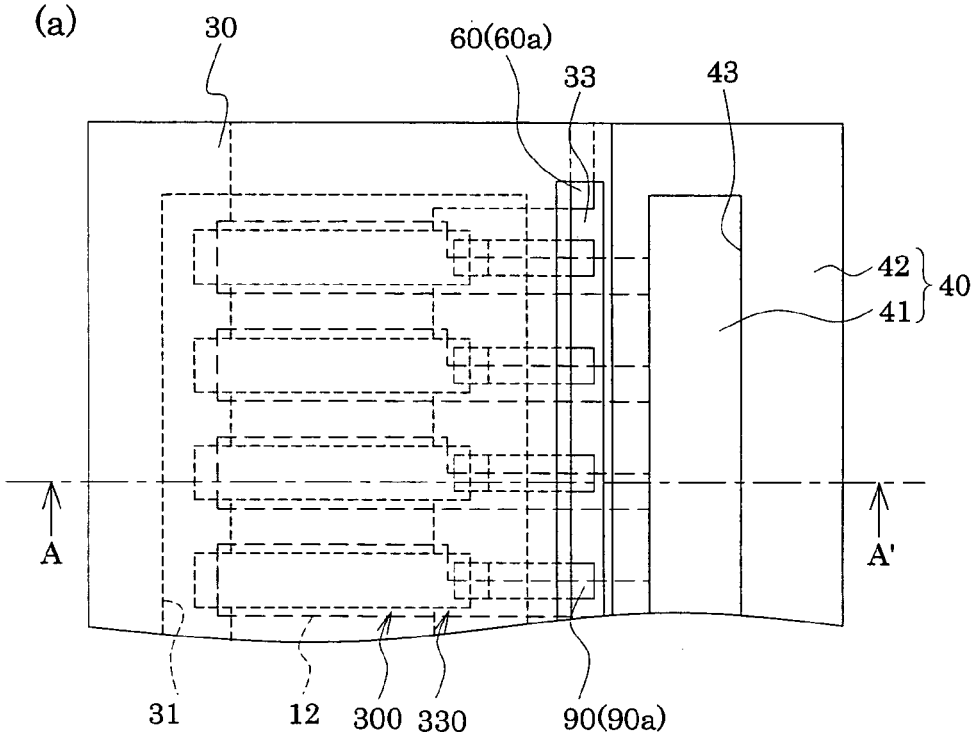
FIGS. 2A-2B show plan and sectional views of the recording head according to Embodiment 1.
Figure 2:
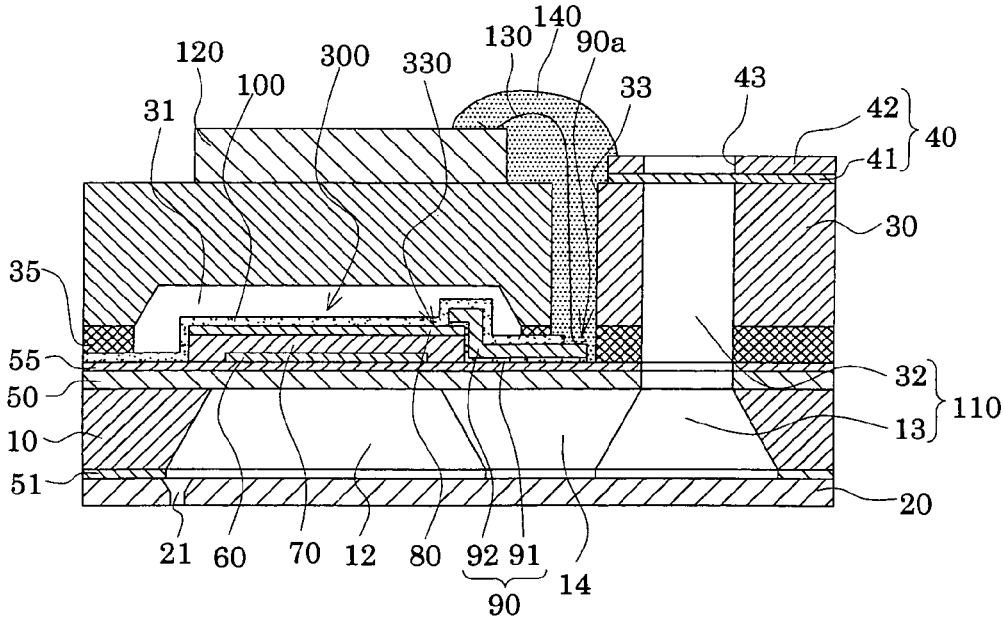

FIG. 1 is an exploded perspective view of an ink-jet recording head according to Embodiment 1 of the present invention. FIG. 2 shows plan and sectional views of the recording head of FIG. 1. As shown in these drawings, in the present embodiment a channel substrate 10 is formed of a monocrystalline silicon substrate which has a crystal face orientation of (110). An elastic film 50 is formed beforehand on one side of the channel substrate 10 by means of thermal oxidation. The elastic film 50 is formed of silicon dioxide and has a thickness of 0.5 μm to 2 μm. In the channel substrate 10, a plurality of pressure generation chambers 12 are provided in proximity, in a row arrangement in their width direction. A communication section 13 is formed in the channel substrate 10 in a region located longitudinally outside the pressure generation chambers 12. The communication section 13 communicates with the pressure generation chambers 12 via corresponding ink supply channels 14 provided for the pressure generation chambers 12. The communication section 13 communicates with a reservoir section of a protective plate, which will be described later, and partially constitutes a reservoir, which serves as a common ink chamber for the pressure generation chambers 12. The ink supply channels 14 are formed narrower than the pressure generation chambers 12 so as to maintain constant flow resistance of ink flowing into the pressure generation chambers 12 from the communication section 13.

A nozzle plate 20 is bonded to the orifice side of the channel substrate 10, by use of adhesive, a thermally fusing film, or the like, via an insulating film 51 having been used as a mask for formation of the pressure generation chambers 12. Nozzle orifices 21 are formed through the nozzle plate 20 and communicate with the corresponding pressure generation chambers 12 at end portions opposite the ink supply channels 14. Notably, the nozzle plate 20 has a thickness of, for example, 0.01 mm to 1 mm, and is made of a suitable material, such as glass ceramic, monocrystalline silicon substrate, or stainless steel, which has a coefficient of linear expansion of, for example, 2.5 to $4.5\times10^{-6}$/° C. at 300° C. or less.

As described above, the elastic film 50 having a thickness of, for example, about 1.0 μm is formed on a side of the channel substrate 10 opposite the orifice side. An insulating film 55 having a thickness of, for example, about 0.4 μm is formed on the elastic film 50. A lower electrode film 60 having a thickness of, for example, about 0.2 μm, a piezoelectric layer 70 having a thickness of, for example, about 1.0 μm, and an upper electrode film 80 having a thickness of, for example, about 0.05 μm are formed in layers on the insulating film 55 by a process to be described later, thereby forming a piezoelectric element 300. Herein, the piezoelectric element 300 refers to a section that includes the lower electrode film 60, the piezoelectric layer 70, and the upper electrode film 80. Generally, either the lower electrode or the upper electrode of the piezoelectric element 300 assumes the form of a common electrode for use among the piezoelectric elements 300, whereas the other electrode and the piezoelectric layer 70 are formed, through patterning, for each of the pressure generation chambers 12. The other electrode and the piezoelectric layer 70 formed through patterning constitute a piezoelectric active portion, which produces a piezoelectric strain when voltage is applied between the upper and lower electrodes. According to the present embodiment, the lower electrode film 60 serves as a common electrode for use among the piezoelectric elements 300, whereas the upper electrode film 80 serves as an individual electrode for use with a piezoelectric element 300. However, the configuration may be reversed in accordance with needs of a drive circuit and wiring. In either case, piezoelectric active portions are formed individually for corresponding pressure generation chambers. Herein, a piezoelectric element 300 and the vibration plate, which is displaced through activation of the piezoelectric element 300, constitute a piezoelectric actuator.

Figure 3:
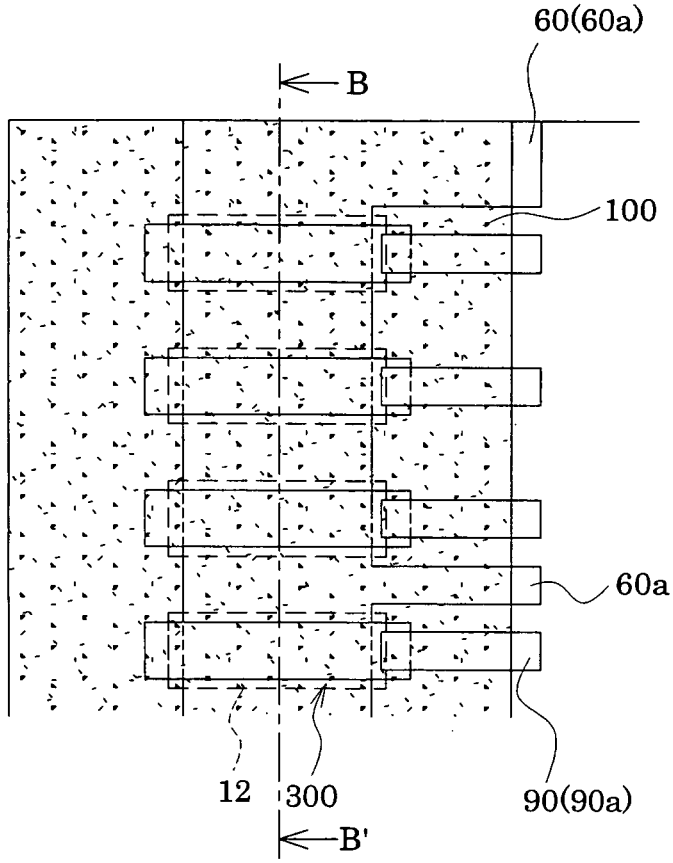
FIGS. 3A-3B show plan and sectional views of a main portion of the recording head according to Embodiment 1.
Figure 3:
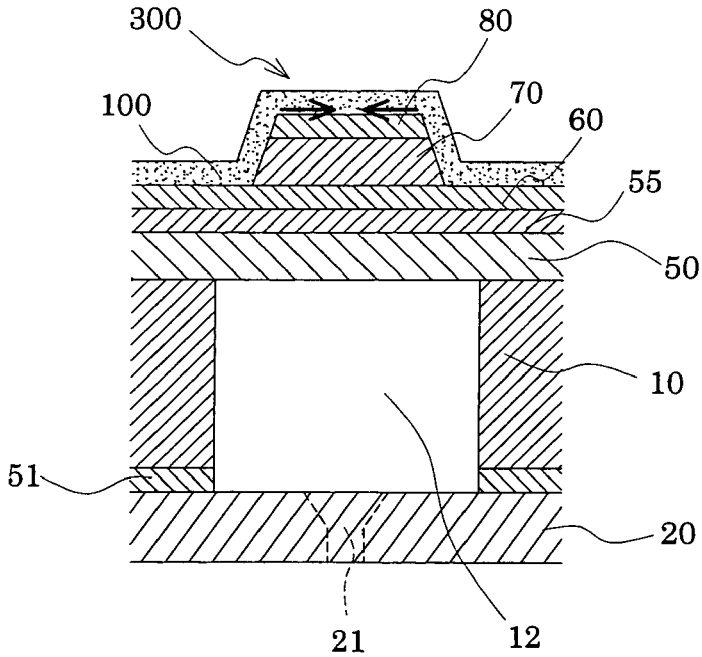

In the present embodiment, as shown in FIGS. 2 and 3, the lower electrode film 60 is formed in a region facing the pressure generation chambers 12 with respect to the longitudinal direction of the pressure generation chambers 12 and extends continuously through respective regions corresponding to the plurality of pressure generation chambers 12. Further, at a location outside the row of the pressure generation chambers 12 and at a location between the piezoelectric elements 300, the lower electrode film 60 extends to the vicinity of the communication section 13. The end portions of these extensions serve as connection portions 60*a*, to which drive wiring 130 to be described later is connected. The piezoelectric layer 70 and the upper electrode layer 80 are basically provided within a region facing each pressure generation chamber 12. However, with respect to the longitudinal direction of the pressure generation chamber 12, they extend to a point outside the end portion of the lower electrode film 60, and the end surface of the lower electrode film 60 is covered with the piezoelectric layer 70. A piezoelectric non-active portion 330, which includes a piezoelectric layer but is not substantially driven, is formed in the vicinity of the longitudinal end of each pressure generation chamber 12. A lead electrode 90 for the upper electrode is connected to one end of the upper electrode film 80. In the present embodiment, the upper-electrode lead electrode 90 extends from a point on the piezoelectric non-active portion 330 located outside the pressure generation chamber 12 to the vicinity of the communication section 13, and the end portion of the extension serves as a connection portion 90*a* to which the drive wiring 130 is connected, as in the case of the lower electrode film 60.

In the present invention, at least pattern regions of the respective layers that constitute the piezoelectric elements 300 are covered with an insulating film 100 formed of an inorganic insulating material. In the present embodiment, the pattern regions of the respective layers that constitute the piezoelectric elements 300 and a pattern region of the upper-electrode lead electrodes 90 are covered with the insulating film 100, except for regions facing the connection portions 60*a* of the lower electrode film 60 and the connection portions 90*a* of the upper-electrode lead electrodes 90. That is, the surfaces (upper surfaces and end surfaces) of the lower electrode film 60, the piezoelectric layers 70, the upper electrode films 80, and the upper-electrode lead electrodes 90 in the pattern regions are covered with the insulating film 100 formed of an inorganic insulating material.

Since the insulating film 100 formed of an inorganic insulating material has very low permeability against water even when its thickness is small, breakage of the piezoelectric layers 70 due to water (moisture) can be prevented by means of covering the surfaces of at least the surfaces of the lower electrode film 60, the piezoelectric layers 70, and the upper electrode films 80 with the insulating film 100, and, in the present embodiment, further covering the surfaces of the upper-electrode lead electrodes 90 with the insulating film 100. Since the surfaces of the respective layers that constitute the piezoelectric elements 300 and the upper-electrode lead electrodes 90 are covered with the insulating film 100, except for the connection portions 60*a* and 90*a*, even when water enters through a clearance between these layers and the insulating film 100, water can be prevented from reaching the piezoelectric layers 70, whereby breakage of the piezoelectric layers 70 due to water can be prevented more reliably.

No limitation is imposed on the material of the insulating film 100, insofar as the material is an inorganic insulating material. Examples of such an inorganic insulating material include aluminum oxide ($AlO_X$) and tantalum oxide ($TaO_X$). In particular, use of aluminum oxide ($Al_2O_3$), which is an inorganic amorphous material, is preferred.

When the insulating film 100 is formed of aluminum oxide, the insulating film 100 preferably has a thickness of about 30 to 150 nm, more preferably about 100 nm. In the case where aluminum oxide is used as a material for the insulating film 100, even when the insulating film 100 is formed to have a thickness as thin as 100 nm, permeation of water under a high humidity environment can be prevented sufficiently. Notably, in the case where an organic insulating material such as resin is used as a material for the insulating film, permeation of water cannot be prevented sufficiently if the insulating film has a small thickness similar to that of the above-described insulating film formed of the inorganic insulating material. Further, increasing the thickness of the insulating film so as to prevent permeation of water may hinder displacement of the piezoelectric elements.

The insulating film 100 formed of aluminum oxide preferably has a film density of 3.08 to 3.25 g/cm$^3$. Further, the insulating film 100 preferably has a Young's modulus of elasticity of 170 to 200 GPa. Covering the piezoelectric elements 300, etc. with the insulating film 100 having such properties prevents permeation of water under a high-humidity environment more reliably, without hindering displacement of the piezoelectric elements 300. Notably, the insulating film 100 is formed by CVD or any other suitable process. The insulating film 100 having desired properties, such as film density and Young's modulus of elasticity, can be formed relatively easily through adjustment of various conditions, such as temperature and gas flow rate, under which the insulating film 100 is formed.

The sum of stress of the insulating film 100 and stress of the upper electrode film 80; i.e., the sum of stress of the upper electrode film 80 and that of the insulating film 100 formed on the upper electrode film 80, is preferably compressive stress. The stress of the insulating film 100 and the stress of the upper electrode film 80 refer to internal stresses (film stresses) generated within the respective films, and the stress $\sigma$ of the upper electrode film 80 and that of the insulating film 100 are each represented by the product of Young's modulus of elasticity Y, distortion $\epsilon$, and film thickness m; i.e., $\epsilon \times Y \times m$.

The internal stresses of the piezoelectric elements 300 located in regions facing the pressure generation chambers 12 change upon formation of the pressure generation chambers 12 during a manufacturing process, which will be described later. Specifically, during formation of the pressure generation chambers 12 under the piezoelectric elements 300 after formation of the piezoelectric elements 300, the internal stress of the piezoelectric layer 70 in the tensile direction is relaxed, and a force is generated in a direction (compressive direction) such that the vibration plate deforms toward the pressure generation chambers. However, in the present embodiment, the piezoelectric elements 300 are covered with the insulating film 100 formed of an inorganic insulating material, and the sum of stress of the insulating film 100 and stress of the upper electrode film 80 is compressive stress. Therefore, after formation of the pressure generation chambers 12, stresses (compressive stresses) of the insulating film 100 and the upper electrode film 80 are released, so that a force in the tensile direction acts on the piezoelectric elements 300 (the piezoelectric layer 70). This effectively prevents a decrease in amount of displacement of the vibration plate caused through drive of the piezoelectric elements 300, while reliably preventing breakage of the piezoelectric layer 70 under influence of the external environment such as water.

Both the stress of the insulating film 100 and the stress of the upper electrode film 80 may be compressive. Alternatively, the stress of the insulating film 100 may be compressive and the stress of the upper electrode film 80 tensile. In this case, the stress $\sigma_1$ of the upper electrode film 80 and the stress $\sigma_2$ of the insulating film 100 satisfy the relation $|\sigma_1|<|\sigma_2|$.

Figure 4:
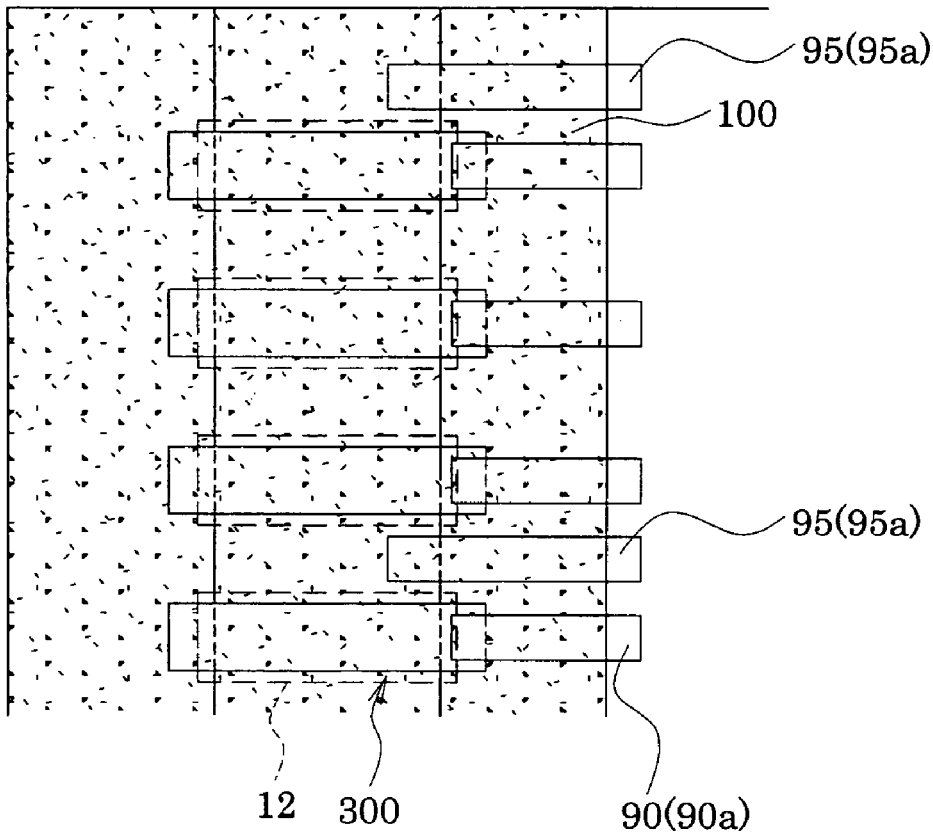
FIG. 4 is a plan view showing a modification of the recording head according to Embodiment 1.

In the present embodiment, the end portions of extensions of the lower electrode film 60 extending to the vicinity of the communication section 13 serve as the connection portions 60*a* for connection with the drive wring 130. However, this configuration may be modified as shown in FIG. 4. That is, the lower-electrode lead electrodes 95, which are electrically connected to the lower electrode film 60 and located outside the row of the piezoelectric elements 300 and between the piezoelectric elements 300, extend to the vicinity of the communication section 13, and the end portions of the lower-electrode lead electrodes 95 serve as the connection portions 95*a* for connection with the drive wring 130. In this case, the pattern region, except for the connection portions 90*a* of the upper-electrode lead electrodes 90 and the connection portions 95*a* of the lower-electrode lead electrode 95, is covered with the insulating film 100 formed of an inorganic insulating material.

Further, a protective plate 30 is bonded to the channel substrate 10 on the side toward the piezoelectric elements 300, via adhesive 35. The protective plate 30 has a piezoelectric-element-holding portion 31 in a region facing the piezoelectric elements 300 so as to secure a space of a size which does not hinder movements of the piezoelectric elements 300. Since the piezoelectric elements 300 are formed within the piezoelectric-element-holding portion 31, the piezoelectric elements 300 are protected and hardly influenced by the external environment. Moreover, a reservoir section 32 is formed in the protective plate 30 in a region corresponding to the communication section 13 of the channel substrate 10. In the present embodiment, this reservoir section 32 penetrates the protective plate 30 in the thickness direction and extends along the row of the pressure generation chambers 12. As described above, the reservoir section 32 communicates with the communication section 13 of the channel substrate 10 to thereby constitute a reservoir 110, which serves as a common ink chamber for the pressure generation chambers 12.

Further, in a region of the protective plate 30 between the piezoelectric-element-holding portion 31 and the reservoir section 32, a through-hole 33 penetrates the protective plate 30 in the thickness direction. The above-described connection portions 60*a* of the lower electrode film 60 and the above-described connection portions 90*a* of the upper-electrode lead electrodes 90 are exposed within the through-hole 33. The drive wiring 130, which serves as connection wiring for establishing electrical connection between a drive IC 120 mounted on the protective plate 30 and the piezoelectric elements 300, is connected to the connection portions 60*a* of the lower electrode film 60 and the connection portions 90*a* of the upper-electrode lead electrodes 90. In the present embodiment, the drive wiring 130 is formed of bonding wires, and is caused to extend into the through-hole 33 so as to electrically connect the drive IC 120 to the connection portions 60*a* of the lower electrode film 60 and the connection portions 90*a* of the upper-electrode lead electrodes 90. Notably, the through-hole 33, through which the drive wiring 130 extends, is filled with a sealing material 140, which is an organic insulating material (in the present embodiment, potting material). Thus, the connection portions 60*a* of the lower electrode film 60, the connection portions 90*a* of the upper-electrode lead electrodes 90, and the drive wiring 130 are completely covered with the sealing material 140.

Examples of the material of the protective plate 30 include glass, ceramic, metal, and resin. However, the protective plate 30 is preferably formed of a material having a coefficient of thermal expansion approximately equal to that of the channel substrate 10. In the present embodiment, the protective plate 30 is formed of a monocrystalline silicon substrate, which is the same material as that used for the channel substrate 10.

A compliance substrate 40 is bonded onto the protective plate 30. The compliance substrate 40 includes a sealing film 41 and a fixing plate 42. The sealing film 41 is formed of a flexible material having low rigidity (e.g., polyphenylene sulfide (PPS) having a thickness of 6 μm). One end surface of the reservoir section 32 is sealed by means of the sealing film 41. The fixing plate 42 is formed of a hard, rigid material, such as metal (e.g., stainless steel (SUS) having a thickness of 30 μm). A region of the fixing plate 42 that faces the reservoir 110 is completely removed in the thickness direction of the fixing plate 42, thereby forming an opening portion 43. As a result, one side of the reservoir 110 is sealed merely with the sealing film 41 having flexibility.

The thus-configured ink-jet recording head of the present embodiment operates in the following manner. Unillustrated external ink supply means supplies ink to the ink-jet recording head. The thus-supplied ink fills an internal space extending from the reservoir 110 to the nozzle orifices 21. Subsequently, in accordance with a record signal from the drive IC 120, voltage is applied between the lower electrode film 60 and the upper electrode film 80 corresponding to each of the pressure generation chambers 12, thereby causing the elastic film 50, the insulating film 55, the lower electrode film 60, and the piezoelectric layer 70 to be deformed in a deflected manner. As a result, pressure within the pressure generation chambers 12 increases, thereby causing ink droplets to be discharged from the corresponding nozzle orifices 21.

Figure 5:
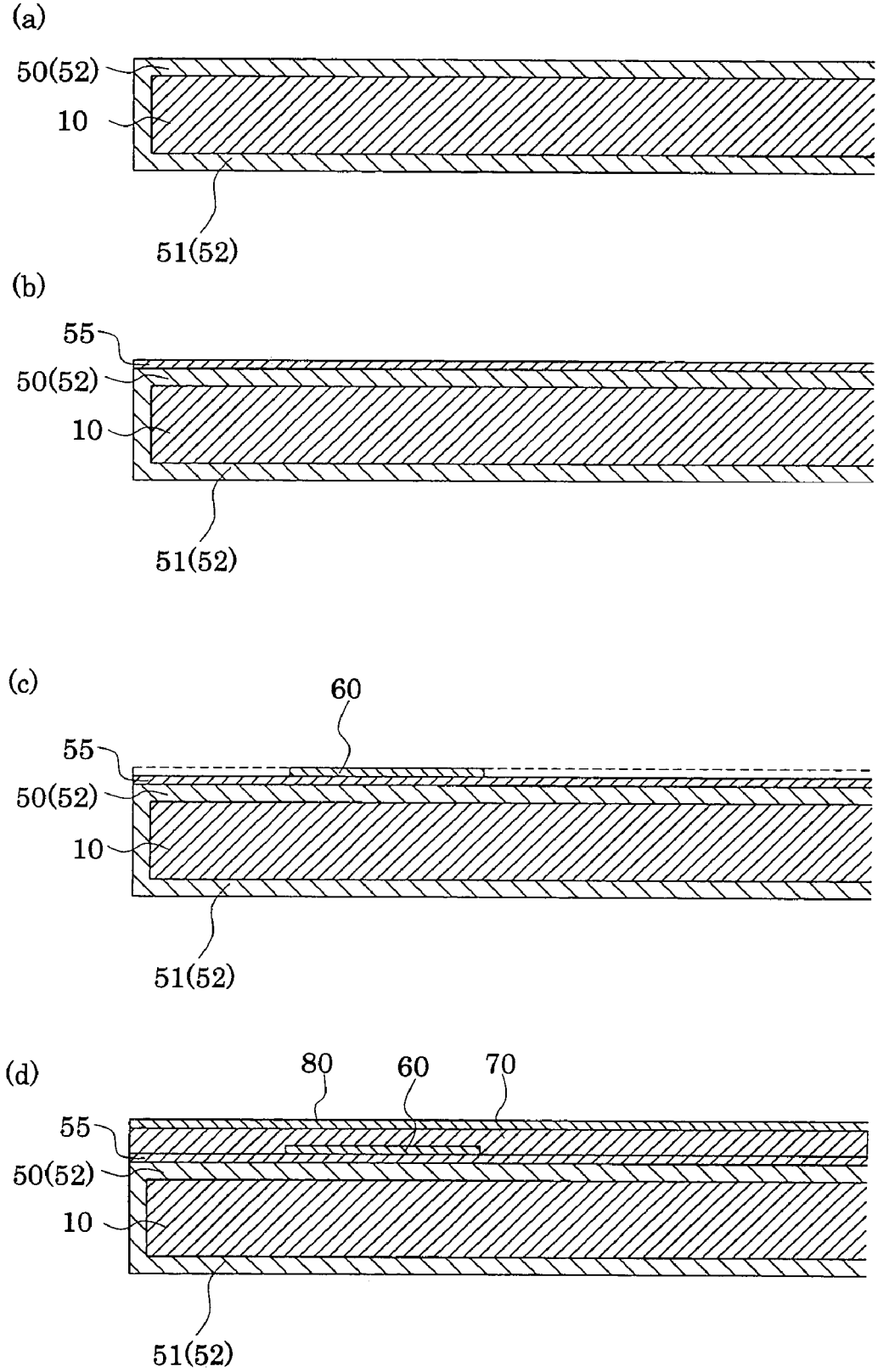
FIGS. 5A-5D are sets of sectional views showing steps of manufacturing the recording head according to Embodiment 1.
Figure 6:
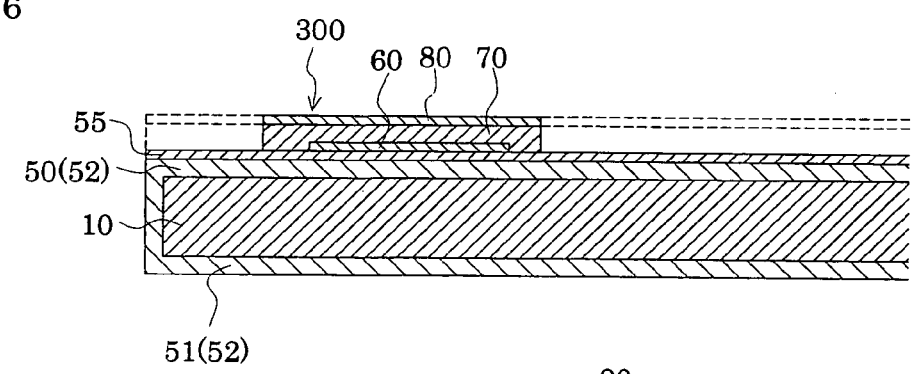
FIGS. 6A-6D are sets of sectional views showing steps of manufacturing the recording head according to Embodiment 1.
Figure 6:
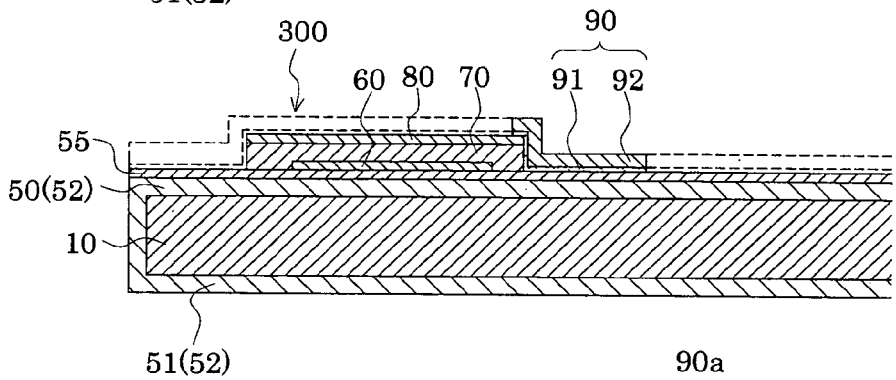
Figure 6:
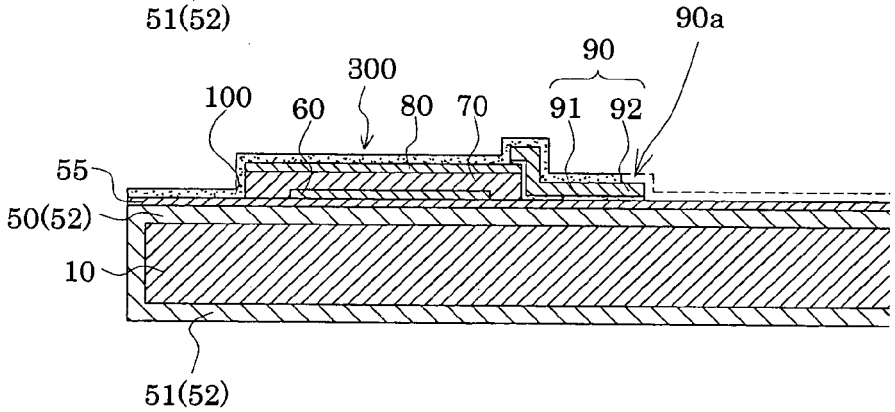
Figure 6:
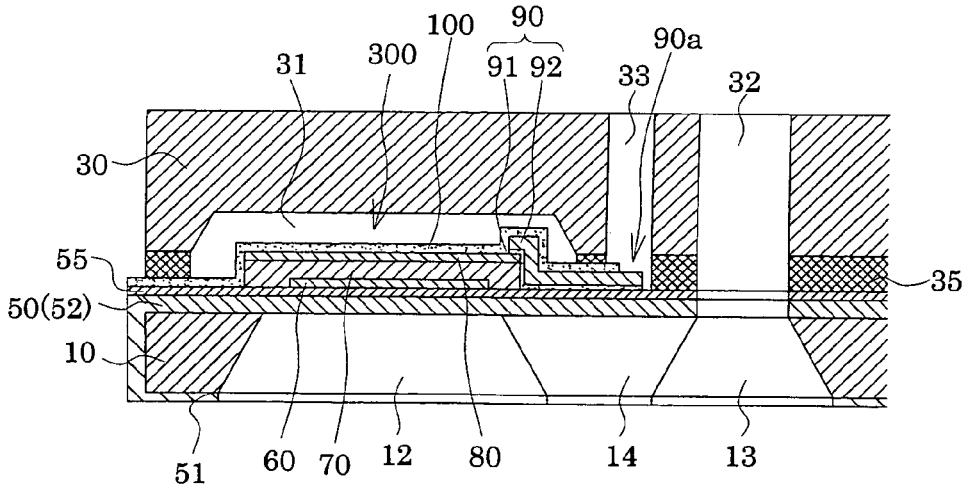

A method for manufacturing such an ink-jet recording head will be described with reference to FIGS. 5 and 6. Notably, FIGS. 5 and 6 are sectional views taken along the longitudinal direction of the pressure generation chambers 12. First, as shown in FIG. 5(*a*), the channel substrate 10, which is a monocrystalline silicon substrate, is thermally oxidized at about 1100° C. in a diffusion furnace, thereby forming silicon dioxide films 52, which serve as the elastic film 50 and a mask film 51, on the surface of the channel substrate 10. Next, as shown in FIG. 5(*b*), after a zirconium (Zr) layer is formed on the elastic film 50 (silicon dioxide film 52), the channel substrate 10 is thermally oxidized at, for example, 500° C. to 1,200° C. in the diffusion furnace, thereby forming the insulating film 55, which is formed of zirconium oxide ($ZrO_2$). Next, as shown in FIG. 5(*c*), the lower electrode film 60 is formed on the insulating film 55 by use of platinum and iridium. Subsequently, the lower electrode film 60 is patterned to a predetermined shape.

Next, as shown in FIG. 5(*d*), the piezoelectric layer 70 formed of, for example, lead zirconate titanate (PZT) and the upper electrode film 80 formed of, for example, iridium are formed over the entire surface of the channel substrate 10. Subsequently, as shown in FIG. 6(*a*), the piezoelectric layer 70 and the upper electrode film 80 are patterned to correspond to the pressure generation chambers 12, to thereby form the piezoelectric elements 300.

Notably, in place of ferroelectric piezoelectric materials such as lead zirconate titanate (PZT), the piezoelectric layer 70, which constitutes the piezoelectric element 300, can be formed by use of relaxor ferroelectric material which is obtained by adding, to a ferroelectric piezoelectric material, a metal such as niobium, nickel, magnesium, bismuth, or yttrium. Although its composition may be freely selected in consideration of the characteristics, application, etc. of the piezoelectric elements 300, examples of the composition include $PbTiO_3$(PT), $PbZrO_3$(PZ), $Pb(Zr_XTi_{1-X})O_3$ (PZT), $Pb(Mg_{1/3}Nb_{2/3})O_3$—$PbTiO_3$(PMN—PT), $Pb(Zn_{1/3}Nb_{2/3})O_3$—$PbTiO_3$(PZN—PT), $Pb(Ni_{1/3}Nb_{2/3})O_3$—$PbTiO_3$(PNN—PT), $Pb(In_{1/2}Nb_{1/2})O_3$—$PbTiO_3$(PIN—PT), $Pb(Sc_{1/3}Ta_{1/2})O_3$—$PbTiO_3$(PST-PT), $Pb(Sc_{1/3}Nb_{1/2})O_3$—$PbTiO_3$(PSN—PT), $BiScO_3$—$PbTiO_3$(BS—PT), and $BiYbO_3$—$PbTiO_3$(BY—PT).

Next, the upper-electrode lead electrodes 90 are formed. Specifically, as shown in FIG. 6(*b*), a close contact layer 91 formed of, for example, titanium tungsten (TiW) is formed over the entire surface of the channel substrate 10, and a metal layer 92 formed of, for example, gold (Au) is formed over the entire surface of the close contact layer 91. After that, the metal layer 92 is patterned for each piezoelectric element 300 via a mask pattern (not shown) formed of resist or the like, and the close contact layer 91 is patterned through etching, whereby the upper-electrode lead electrodes 90 are formed. Notably, the close contact layer 91 is preferably etched in such a manner that its end surface is located to coincide with the end surface of the metal layer 92 or located outside the end surface of the metal layer 92.

Next, as shown in FIG. 6(*c*), the insulating film 100 of aluminum oxide ($Al_2O_3$) is formed, and is then patterned to a predetermined shape. Specifically, the insulating film 100 is formed over the entire surface of the channel substrate 10. Subsequently, the insulating film 100 is removed from regions corresponding to the connection portions 60*a* of the lower electrode film 60 and the connection portions 90*a* of the upper-electrode lead electrodes 90. Notably, in the present embodiment, the insulating film 100 is removed from regions corresponding to the connection portions 60*a* and 90*a*, and from the remaining region except for the pattern regions of the constituting layers of the piezoelectric elements 300 and the upper-electrode lead electrodes 90. Needless to say, the insulating film 100 may be removed from only the regions corresponding to the connection portions 60*a* and 90*a*. In either case, the essential requirement is that the insulating film 100 covers the pattern regions of the layers of the piezoelectric elements 300 and the upper-electrode lead electrodes 90, except for the connection portions 60*a* of the lower electrode film 60 and the connection portions 90*a* of the upper-electrode lead electrodes 90. No limitation is imposed on the method of removing the insulating film 100. However, use of dry etching such as ion milling is preferred. This enables proper removal of the insulating film 100 with high dimensional accuracy.

Next, as shown in FIG. 6(*d*), the protective plate 30 is bonded to the channel substrate 10 on the side toward the piezoelectric elements 300 by use of the adhesive 35. Subsequently, via the mask film 51 patterned to a predetermined shape, the channel substrate 10 is anisotropically etched so as to form the pressure generation chambers 12, etc. Then, the elastic film 50 and the insulating film 55 are mechanically removed so as to establish communication between the communication section 13 and the reservoir section 32.

In actual practice, a large number of chips are simultaneously formed on a single wafer by means of a series of film formation steps as described above and anisotropic etching. Subsequently, the wafer is diced into chips each corresponding to the channel substrate 10 shown in FIG. 1. Subsequently, the nozzle plate 20 is bonded to the channel substrate 10 via the mask film 51, a drive IC 120 is mounted to the protective plate 30, and the compliance substrate 40 is bonded to the protective plate 30. Further, through wire bonding, the drive wiring 130 is formed between the drive IC 120, and the connection portions 60*a* of the lower electrode film 60 and the connection portions 90*a* of the upper-electrode lead electrodes 90. The connection portions 60*a* and 90*a* and the drive wiring 130 are covered with the sealing material 140, whereby an ink-jet recording head according to the present embodiment is completed.

TEST EXAMPLE 1

Ink-jet recording heads of Examples 1 to 3 and Comparative Examples 1 to 3 as described below were fabricated, and tested under application of DC thereto. The test conditions and test results are shown below in Table 1.

EXAMPLE 1

An ink-jet recording head of Example 1 was manufactured in such a manner that an insulating film of aluminum oxide, which is an inorganic insulating material, was formed to have a thickness of about 50 nm and to cover the pattern regions of the respective layers of the piezoelectric elements and the upper-electrode lead electrodes, except for the connection portions of the lower electrode film and the connection portions of the upper-electrode lead electrodes.

EXAMPLE 2

An ink-jet recording head of Example 2 was manufactured to have the same structure as that of Example 1, except that the insulating film was formed to have a thickness of about 100 nm.

EXAMPLE 3

An ink-jet recording head of Example 3 was manufactured to have the same structure as that of Example 1, except that in place of aluminum oxide, tantalum oxide was used to form the insulating film, and the insulating film had a thickness of about 200 nm.

COMPARATIVE EXAMPLE 1

An ink-jet recording head of Comparative Example 1 was manufactured to have the same structure as that of Example 1, except that silicone oil (product of Daikin Industries, Ltd.) was used to form the insulating film so as to completely cover the surfaces of the piezoelectric elements and the upper-electrode lead electrodes, except for the connection portions of the lower electrode film and the connection portions of the upper-electrode lead electrodes.

COMPARATIVE EXAMPLE 2

An ink-jet recording head of Comparative Example 2 was manufactured to have the same structure as that of Comparative Example 1, except that urethane-containing damp-proofing agent (product of Hitachi Chemical Co., Ltd.) was used to form the insulating film.

COMPARATIVE EXAMPLE 3

An ink-jet recording head of Comparative Example 3 was manufactured to have the same structure as that of Example 1, except that the insulating film was not formed.

TABLE 1

| | Applied voltage | Temp. | Humidity | Evaluation time | Tested Number of segments | Number of NG segments | Yield |
|---|---|---|---|---|---|---|---|
| Example 1 | 35 V | 25° C. | 40% Rh | 250 H | 48 | 0 | 100% |
| Example 2 | 35 V | 25° C. | 85% Rh | 250 H | 47 | 0 | 100% |
| Example 3 | 35 V | 25° C. | 40% Rh | 150 H | 50 | 0 | 100% |
| Comparative Example 1 | 35 V | 25° C. | 40% Rh | 4 H | 25 | 18 | 28% |
| Comparative Example 2 | 35 V | 25° C. | 40% Rh | 4 H | 30 | 2 | 93% |
| Comparative Example 3 | 35 V | 25° C. | 40% Rh | 4 H | 25 | 4 | 84% |

As shown in Table 1, in the ink-jet recording heads of Examples 1 to 3 each having an insulating film of an inorganic insulating material, no segment (piezoelectric element) was broken even after passage of 150 hours or more under an environment of 40% relative humidity, and their yields were 100%. In particular, in the ink-jet recording head of Example 2 in which aluminum oxide was used, no segment (piezoelectric element) was broken even after passage of 250 hours, despite the considerably severe condition of 85% relative humidity. In contrast, in the ink-jet recording heads of Comparative Examples 1 to 3, each having an insulating film of a material other than inorganic insulating materials or having no insulating film, a portion of the segments was observed to be broken after passage of four hours under an environment of 40% relative humidity. The test revealed that in the ink-jet recording head of the comparative examples, permeation of water occurs more easily as compared with the ink-jet recording head in which the above-described insulating film formed of an inorganic insulating material is provided.

When an insulating film formed of a material other than an inorganic insulating material is used, permeation of water cannot be prevented to a sufficient degree if the insulating film has a small thickness as in the case of the insulating film formed of an inorganic insulating material. Further, when the thickness of the insulating film is increased so as to prevent permeation of water, the insulating film may hinder the drive of the piezoelectric elements 300. Therefore, in order to secure a sufficient level of drive of the piezoelectric elements 300, the piezoelectric elements 300 are required to have a larger size, so that the size of the ink-jet recording head increases.

As is apparent from the results, the structure according to the present invention can reliably prevent breakage of piezoelectric elements due to moisture (water), without increasing the size of the head, to thereby greatly improve the durability of the head.

TEST EXAMPLE 2

Ink-jet recording heads of Examples 4 to 6 and Comparative Example 4 as described below were fabricated, and tested so as to compare the amounts of displacement of their vibration plates. Table 2 provided below show the materials, thicknesses, and film stresses of the upper electrode film and the insulating film of each of the ink-jet recording heads of Examples 4 to 6 and Comparative Example 4. Table 3 provided below show data regarding physical properties (Young's modulus and stress) of materials of the upper electrode film and the insulating film. Notably, in Tables 2 and 3, compressive stress is shown as a negative value, and tensile stress is shown as a positive value.

EXAMPLE 4

An ink-jet recording head of Example 4 was manufactured in such a manner that, as shown in Table 2, an upper electrode film having a thickness of about 50 nm was formed from iridium, and an insulating film having a thickness of about 100 nm was formed from aluminum oxide so as to cover the piezoelectric elements having the upper electrode film.

As shown in Tables 2 and 3, a film formed of iridium produces compressive stress, and a film formed of aluminum oxide produces compressive stress. Therefore, in the ink-jet recording head of Example 4, compressive stress is produced in each of the upper electrode film and the insulating film, and the sum of the stresses produced in the upper electrode film and the insulating film is compressive.

EXAMPLE 5

An ink-jet recording head of Example 5 was manufactured to have the same structure as that of Example 4, except that platinum was used as the material for the upper electrode film.

As shown in Tables 2 and 3, a film formed of platinum produces tensile stress, and a film formed of aluminum oxide produces compressive stress. Therefore, in the ink-jet recording head of Example 5, compressive stress is produced in the insulating film, and tensile stress is produced in the upper electrode film. However, since the stress $\sigma_1$ of the upper electrode film and the stress $\sigma_2$ of the insulating film satisfy the relation $|\sigma_1|<|\sigma_2|$, the sum of the stresses produced in the upper electrode film and the insulating film is compressive.

EXAMPLE 6

An ink-jet recording head of Example 6 was manufactured to have the same structure as that of Example 5, except that the upper electrode film was formed to have a thickness of about 100 nm.

In the ink-jet recording head of Example 6, as in the case of Example 5, compressive stress is produced in the insulating film, and tensile stress is produced in the upper electrode film. However, the sum of the stresses produced in the upper electrode film and the insulating film is compressive.

COMPARATIVE EXAMPLE 4

An ink-jet recording head of Comparative Example 4 was manufactured to have the same structure as that of Example 6, except that the insulating film was not formed.

As shown in Tables 2 and 3, a film formed of platinum produces tensile stress. Therefore, in the ink-jet recording head of Comparative Example 4, tensile stress is produced in the upper electrode film. Since the insulating film which produces stress is not present, the sum of the stresses produced in the upper electrode film and the insulating film is tensile.

TABLE 2

| | Material and thickness (m) [nm] | | Film stress (ϵ × Y × m) [Pa] | | |
|---|---|---|---|---|---|
| | Upper electrode film | Insulating film | Upper electrode film ($\sigma_1$) | Insulating film ($\sigma_2$) | Sum |
| Example 4 | Ir: 50 | $Al_2O_3$: 100 | −40 | −11 | −51 |
| Example 5 | Pt: 50 | $Al_2O_3$: 100 | 5 | −11 | −6 |
| Example 6 | Pt: 100 | $Al_2O_3$: 100 | 10 | −11 | −1 |
| Comparative Example 4 | Pt: 100 | — | 10 | — | 10 |

TABLE 3

| | Young's modulus (Y) [Pa] | Stress (ϵ × Y) [Pa] |
|---|---|---|
| Ir | $5.3 \times 10^{11}$ | $-8.0 \times 10^{8}$ |
| Pt | $1.5 \times 10^{11}$ | $1.0 \times 10^{8}$ |
| $Al_2O_3$ | $2.0 \times 10^{11}$ | $-1.1 \times 10^{8}$ |

As can be understood from the results shown in Table 2, in the ink-jet recording heads of Examples 4 to 6, in which the sum of the stress of the insulating film and the stress of the upper electrode film is compressive, the amount of displacement of the vibration plate caused by drive of the piezoelectric elements is larger than that in the ink-jet recording head of Comparative Example 4 in which the sum of the stress of the insulating film and the stress of the upper electrode film is tensile. As is apparent from this result, a decrease in amount of displacement of the vibration plate caused through drive of the piezoelectric elements can be prevented through generation of a compressive stress as the sum of the stress of the insulating film and the stress of the upper electrode film.

In the ink-jet recording head of Example 4, a larger compressive stress is produced as the sum of the stress of the insulating film and the stress of the upper electrode film, as compared with the ink-jet recording head of Example 5. However, in the ink-jet recording head of Example 5, the piezoelectric element displaces by a greater amount as compared with the ink-jet recording head of Example 4. Conceivably, this phenomenon occurs because, as shown in Tables 2 and 3, the upper electrode film of Example 5 is formed of platinum, and therefore has a Young's modulus (hardness) smaller than that of the upper electrode film of Example 4, which is formed of iridium. As described above, when the sum of the stress of the insulating film and the stress of the upper electrode film is compressive, the quantity of deformation of the vibration plate can be reduced, and the amount of displacement of the vibration plate caused through drive of the piezoelectric elements can be increased. As is also apparent from this result, a decrease in amount of displacement of the vibration plate caused through drive of the piezoelectric elements can be prevented more reliably through generation of a compressive stress as the sum of the stress of the insulating film and the stress of the upper electrode film.

EMBODIMENT 2

Figure 7:
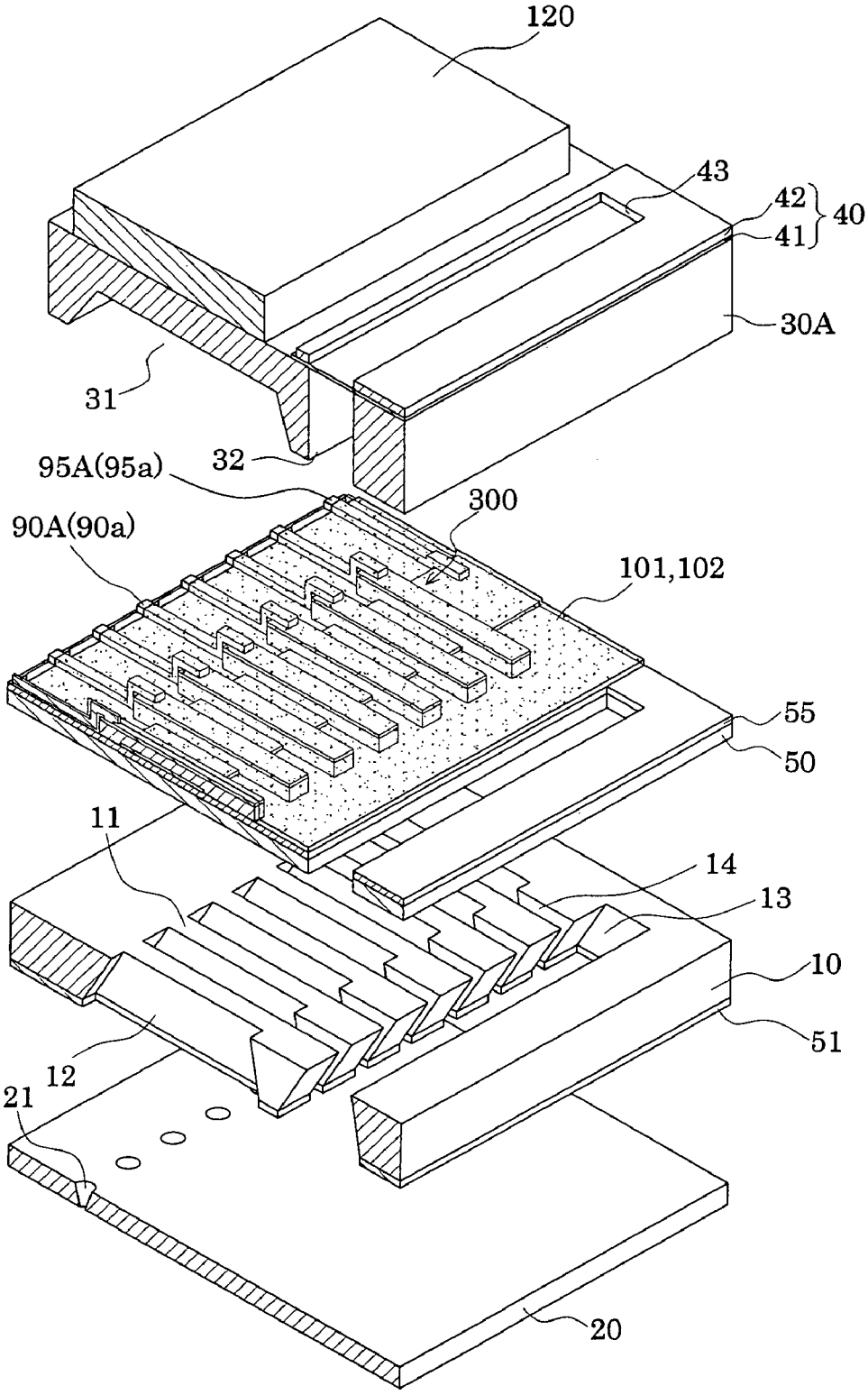
FIG. 7 is a schematic perspective view of a recording head according to Embodiment 2.
Figure 8:
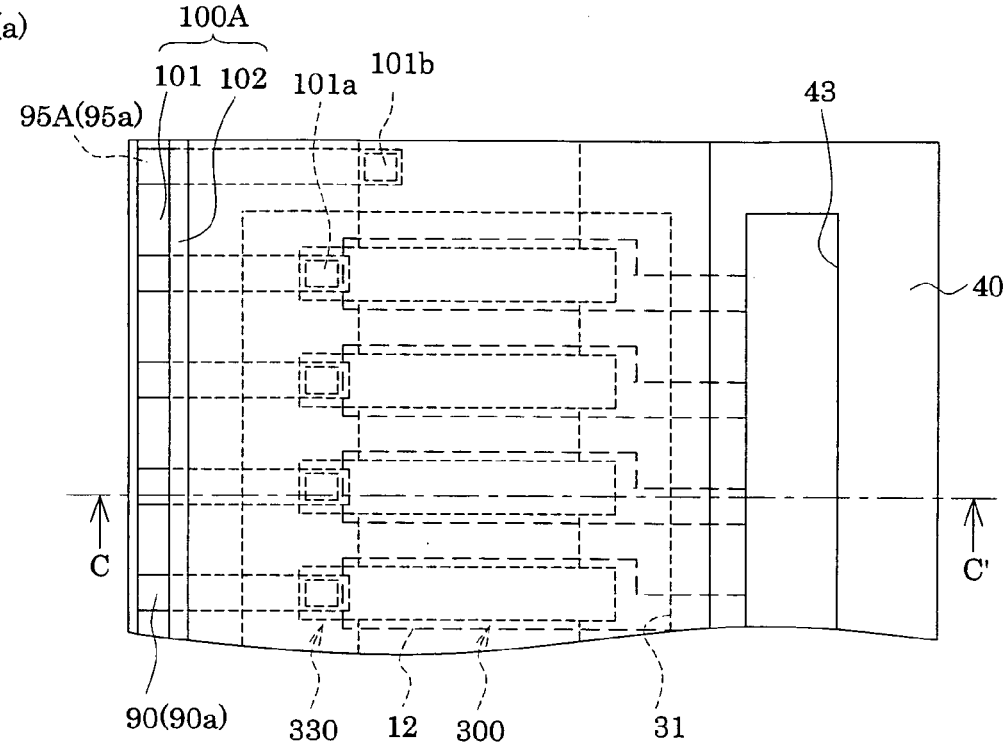
FIGS. 8A-8B show plan and sectional views of the recording head according to Embodiment 2.
Figure 8:
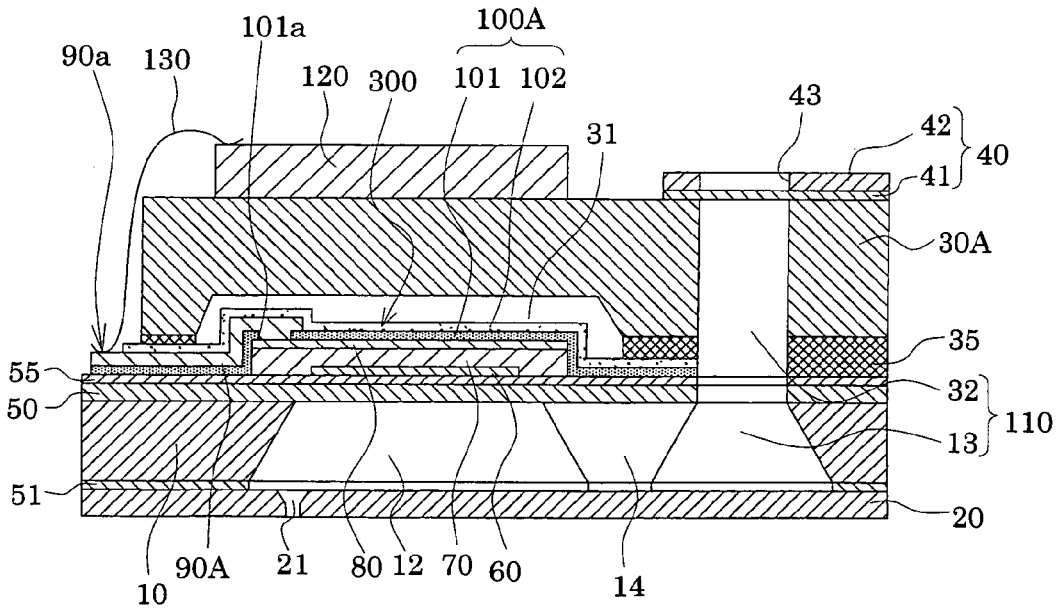
Figure 9:
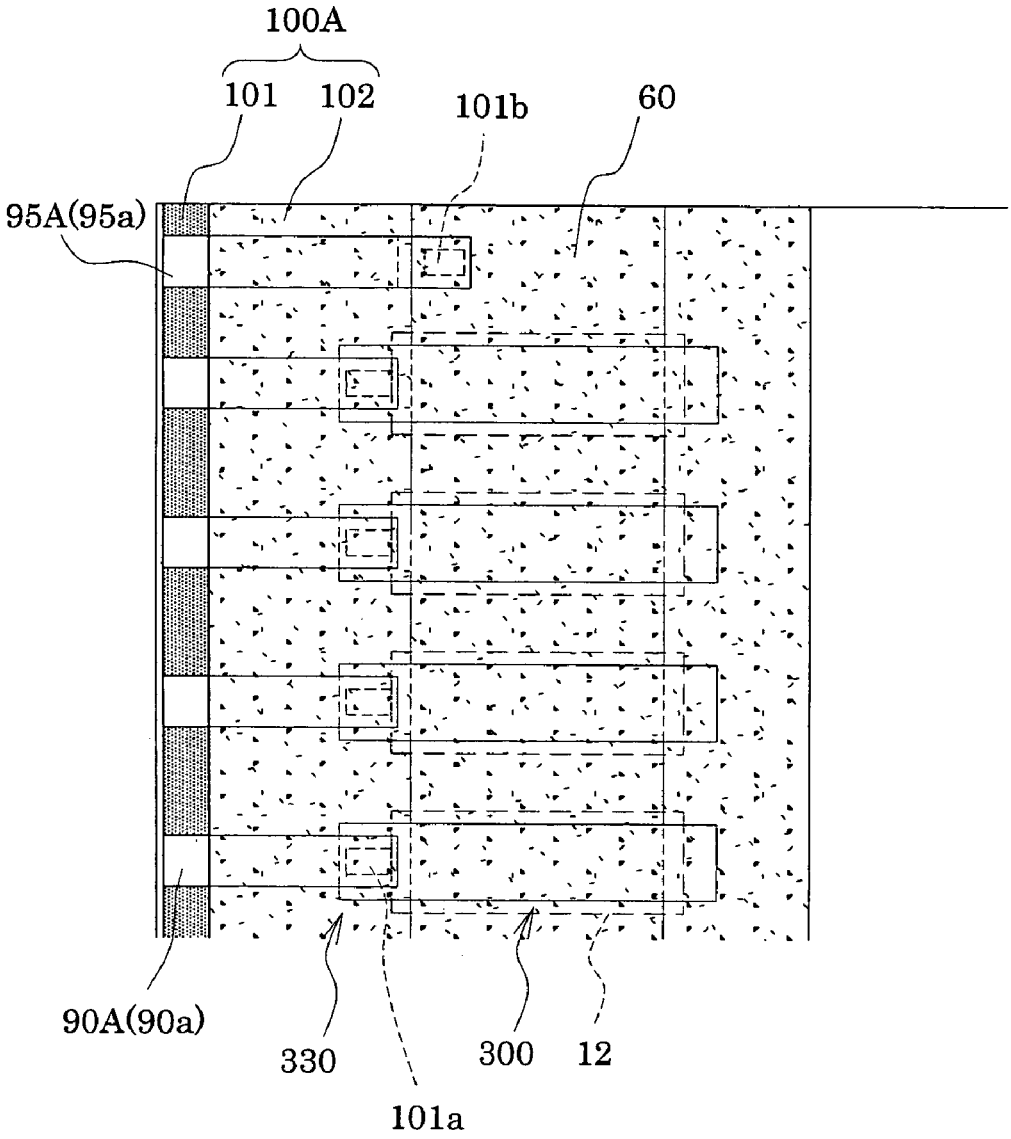
FIG. 9 is a plan view showing a main portion of the recording head according to Embodiment 2.
Figure 10:
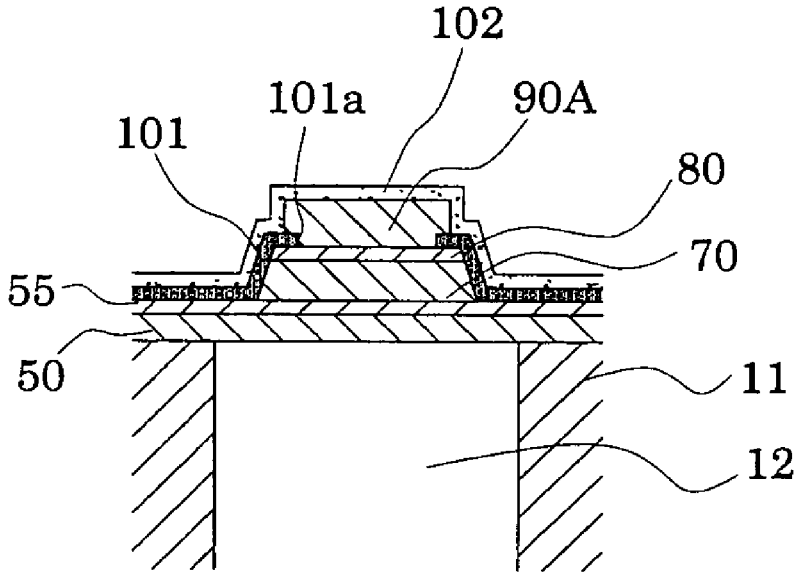
FIGS. 10A-10B are pairs of sectional views showing the main portion of the recording head according to Embodiment 2.
Figure 10:
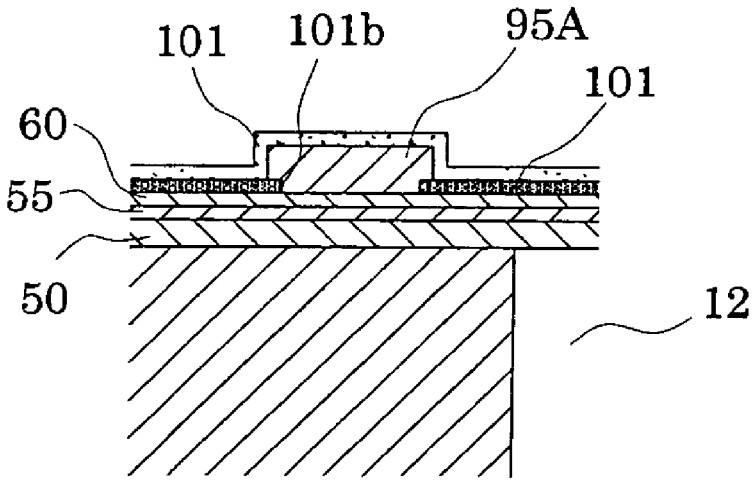

FIG. 7 is a schematic perspective view of an ink-jet recording head according to Embodiment 2; and FIG. 8 shows plan and sectional views of the ink-jet recording head. FIG. 9 is a plan view showing a main portion of the ink-jet recording head; and FIG. 10 is a pair of sectional views showing the main portion of FIG. 9. In the following description, members identical with those in the above-described embodiment are denoted by the same reference numerals, and their repeated descriptions are omitted.

In the present embodiment, at least the constituent layers of piezoelectric elements 300 are covered with an insulating film 100A including a first insulating film 101 and a second insulating film 102. Specifically, as shown in FIGS. 7 to 10, a lower electrode film 60 is formed in a region facing pressure generation chambers 12 with respect to the longitudinal direction of the pressure generation chambers 12 and extends continuously through respective regions corresponding to the plurality of pressure generation chambers 12. Piezoelectric layers 70 and upper electrode films 80 are basically provided within respective regions facing the pressure generation chambers 12. However, with respect to the longitudinal direction of the pressure generation chambers 12, they extend beyond the end portion of the lower electrode film 60, and the end surface of the lower electrode film 60 is covered by the piezoelectric layers 70. A piezoelectric non-active portion 330, which includes the piezoelectric layer 70 but is not substantially driven, is formed in the vicinity of the longitudinal end of each pressure generation chamber 12 (see FIG. 8(*a*)).

In the present embodiment, the surfaces of the constituent layers of the piezoelectric elements 300 are covered with the insulating film 100A formed of a damp-proofing material, except for connection portions 90*a* of upper-electrode lead electrodes 90A and a connection portion 95*a* of a lower-electrode lead electrode 95A. Specifically, as shown in FIGS. 9 and 10, the first insulating film 101 is provided in pattern regions of the constituent layers of the piezoelectric elements 300. Connection holes 101*a* for connecting the upper-electrode lead electrodes 90A and the upper electrode films 80 are formed in regions facing the vicinity of the longitudinal end portions of the upper electrode films 80. A connection hole 101*b* for connecting the lower-electrode lead electrode 95A and the lower electrode film 60 is formed outside the row of the piezoelectric elements 300. That is, at least the pattern regions of the constituent layers of piezoelectric elements 300 are completely covered with the first insulating film 101, except for the connection holes 101*a* and 101*b*.

The upper-electrode lead electrodes 90A to be connected to the upper electrode films 80 of the piezoelectric elements 300 via the connection holes 101*a*, and the lower-electrode lead electrode 95A to be connected to the lower electrode film 60 via the connection hole 101*b* are provided on the first insulating film 101. Each upper-electrode lead electrode 90A extends from the vicinity of one longitudinal end of the corresponding upper electrode film 80 (in the present embodiment, from a portion corresponding to the piezoelectric non-active portion 330) to the vicinity of the end portion of the channel substrate 10. Further, the lower-electrode lead electrode 95A extends from a point outside the row of the piezoelectric elements 300 and near the end portion of the lower electrode film 60 to the vicinity of the end portion of the channel substrate 10. The end portions of the upper-electrode lead electrodes 90A and the lower-electrode lead electrode 95A serve as the connection portions 90*a* and 95*a*, to which the drive wiring 130 is connected.

Further, the second insulating film 102 is provided on the upper-electrode lead electrodes 90A, the lower-electrode lead electrode 95A, and the first insulating film 101. That is, the pattern regions of the upper-electrode lead electrodes 90A, the lower-electrode lead electrode 95A, and the constituent layers of the piezoelectric elements 300 are covered with the second insulating film 102, except for regions facing the connection portions 90*a* of the upper-electrode lead electrodes 90A and the connection portion 95*a* of the lower-electrode lead electrode 95A.

In this structure, by means of the first and second insulating films 101 and 102, breakage of the piezoelectric layers 70 due to water (moisture) can be prevented more reliably. Further, the surfaces of the constituent layers of the piezoelectric elements 300 and the upper-electrode lead electrodes 90A and the lower-electrode lead electrode 95A are covered with the second insulating film 102, except for the connection portions 90*a* of the upper-electrode lead electrodes 90A and the connection portion 95*a* of the lower-electrode lead electrode 95A. Therefore, even when water enters from the side corresponding to the end portion of the second insulating film 102, water can be prevented from reaching the piezoelectric layers 70, whereby breakage of the piezoelectric layers 70 due to water can be reliably prevented.

Further, since the upper-electrode lead electrodes 90A and the lower-electrode lead electrode 95A are formed on the first insulating film 101, electric corrosion does not occur even if wet etching is used for formation of the upper-electrode lead electrodes 90A and the lower-electrode lead electrode 95A. Therefore, anomaly in relation to etching speed stemming from electric corrosion or a like anomaly does not occur, and the upper-electrode lead electrodes 90A and the lower-electrode lead electrode 95A can be formed with high accuracy. Further, it is possible to prevent breakage of the piezoelectric elements 300, such as exfoliation of the upper electrode films 80, which would otherwise occur during etching of the upper-electrode lead electrodes 90A and the lower-electrode lead electrode 95A, whereby yield is greatly improved.

The first and second protective films 101 and 102, which constitute the insulating film 100A, are preferably formed of aluminum oxide ($AlO_x$). The first and second insulating films 101 and 102 may be formed of different materials; for example, such that the first insulating film 101 is formed of silicon oxide, and the second insulating film 102 is formed of aluminum oxide. However, one of the first and second insulating films 101 and 102 is preferably formed of aluminum oxide. Also, preferably, at least the second insulating film 102 is formed of aluminum oxide, and particularly preferably, both the first and second insulating films 101 and 102 are formed of aluminum oxide. Through use of aluminum oxide as the material of either or both of the first and second insulating films 101 and 102, permeation of water in a high-humidity environment can be prevented to a sufficient degree even when the first and second insulating films 101 and 102 are formed to have a relatively small film thickness. For example, in the case where both the first and second insulating films 101 and 102 are formed of aluminum oxide, permeation of water can be prevented to a sufficient degree, even when the first and second insulating films 101 and 102 each have a film thickness of about 50 nm.

Moreover, when aluminum oxide is used as the material of either or both of the first and second insulating films 101 and 102, the upper-electrode lead electrodes 90A and the lower-electrode lead electrode 95A are preferably formed of a material which contains aluminum (Al) as a predominant component. For example, in the present embodiment, each of the first and second insulating films 101 and 102 is formed of aluminum oxide, and the upper-electrode lead electrodes 90A and the lower-electrode lead electrode 95A are formed of an alloy containing 99.5 wt % aluminum (Al) and 0.5 wt % copper (Cu).

With this, the degree of adhesion of the upper-electrode lead electrodes 90A and the lower-electrode lead electrode 95A with the first insulating film 101 or the second insulating film 102 increases. Further, in the case where both the first and second insulating films 101 and 102 are formed of aluminum oxide, not only the degree of adhesion of the upper-electrode lead electrodes 90A and the lower-electrode lead electrode 95A with the first insulating film 101 or the second insulating film 102, but also the degree of adhesion of the first insulating film 101 with the second insulating film 102 increases. Accordingly, permeation of water can be prevented more reliably, and breakage of the piezoelectric elements 300 stemming from water can be reliably prevented over a long period of time. Moreover, even when the first and second insulating films 101 and 102 are made relatively thin, permeation of water can be prevented more reliably, and drive of the piezoelectric elements 300 is not hindered, whereby excellent ink discharge property can be maintained.

As in the case of Embodiment 1, a protective plate and a compliance substrate are bonded to the surface of the channel substrate 10 on the side toward the piezoelectric elements 300. However, the protective plate 30A of the present embodiment differs from the protective plate of Embodiment 1 in that a through-hole portion is not formed in the protective plate 30A. As described above, the upper-electrode lead electrodes 90A and the lower-electrode lead electrode 95A extend to the vicinity of the end portion of the channel substrate 10; i.e., to a position outside the piezoelectric-element-holding portion 31. Ends of the drive wiring 130, which extends from the drive IC 120 mounted on the protective plate 30, are connected to the connection portions 90*a* of the upper-electrode lead electrodes 90A and the connection portion 95*a* of the lower-electrode lead electrode 95A.

Figure 11:
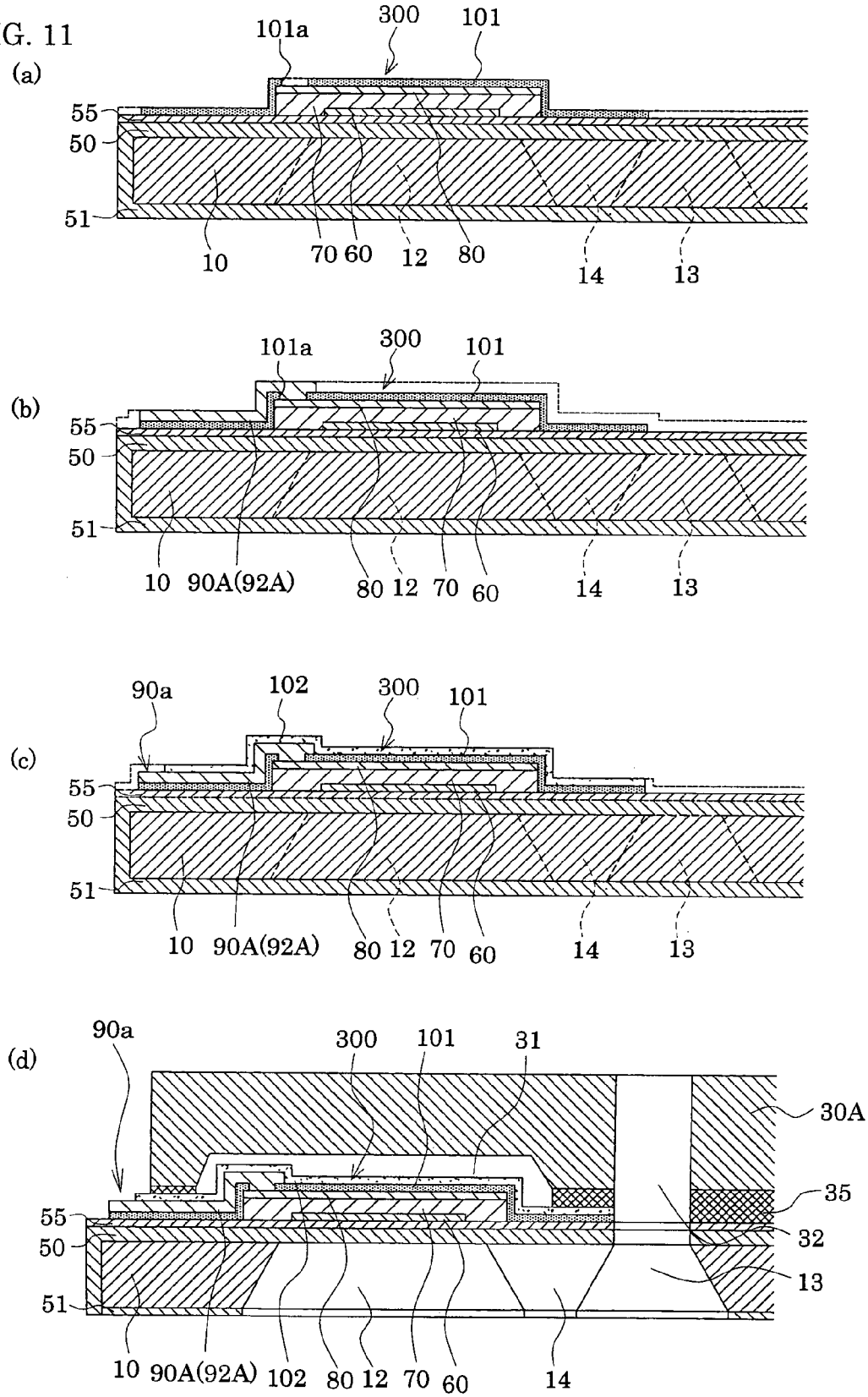
FIGS. 11A-11D are sets of sectional views showing steps of manufacturing the recording head according to Embodiment 2.

A method for manufacturing the ink-jet recording head according to the present embodiment will be described. FIG. 11 is a set of sectional views taken along the longitudinal direction of the pressure generation chambers 12. First, as described in Embodiment 1, the elastic film 50 and the insulating film 55 are formed on the channel substrate 10, and the piezoelectric elements 300, each composed of the lower electrode film 60, the piezoelectric layer 70, and the upper electrode film 80, are formed on the insulating film 55 (see FIG. 5(*a*) to FIG. 6(*a*)).

Subsequently, as shown in FIG. 11(*a*), the first insulating film 101 of aluminum oxide is formed, and is then patterned to a predetermined shape. Specifically, the first insulating film 101 is formed over the entire surface of the channel substrate 10. Subsequently, the first insulating film 101 is etched via a predetermined mask so as to form the connection holes 101*a* and 101*b* in a region facing the upper electrode films 80 and a region facing the lower electrode film 60 outside the row of the piezoelectric elements 300.

Next, as shown in FIG. 11(*b*), the upper-electrode lead electrodes 90A are formed. Specifically, a metal layer 92A formed of a material containing aluminum (Al) as a predominant component is formed over the entire surface of the channel substrate 10. Subsequently, the metal layer 92A is patterned for each piezoelectric element 300 via a mask pattern (not shown) formed of resist or the like, whereby the upper-electrode lead electrodes 90A are formed. Although not illustrated, at that time, the lower-electrode lead electrode 95A is formed simultaneously.

Use of the material containing aluminum as a predominant component as the material for the metal layer 92A is preferable, because the degree of adhesion with the first or second insulating film 101 or 102 is improved, and the ratio of permeation of water to the piezoelectric layer decreases further. Needless to say, gold (Au) or the like may be used to form the metal layer 92A. However, in such a case, a close contact layer formed of, for example, titanium tungsten (TiW) is desirably provided underneath the metal layer. Needless to say, even when the metal layer is formed of aluminum, a close contact layer formed of titanium tungsten may be provided.

Next, as shown in FIG. 11(*c*), the second insulating film 102 of, for example, aluminum oxide is formed, and is then patterned to a predetermined shape. Specifically, the second insulating film 102 is formed over the entire surface of the channel substrate 10, and then removed from the regions facing the connection portions 90*a* of the upper-electrode lead electrodes 90A and the connection portion 95*a* of the lower-electrode lead electrode 95A. In the present embodiment, the second insulating film 102 is formed in substantially the same regions as those of the first insulating film 101; i.e., only in the pattern regions of the constituent layers of the piezoelectric elements 300, the upper-electrode lead electrodes 90A, and the lower-electrode lead electrode 95A. Needless to say, the second insulating film 102 may be formed on the entire surface other than the regions facing the connection portions 90*a* of the upper-electrode lead electrodes 90A and the connection portion 95*a* of the lower-electrode lead electrode 95A. In either case, the essential requirement is that the second insulating film 102 covers the pattern regions of the constituent layers of the piezoelectric elements 300, the upper-electrode lead electrodes 90A, and the lower-electrode lead electrode 95A, except for the connection portions 90*a* of the upper-electrode lead electrodes 90A and the connection portion 95*a* of the lower-electrode lead electrode 95A.

Next, as shown in FIG. 11(*d*), the protective plate 30 is bonded to the channel substrate 10 on the side toward the piezoelectric elements 300 by use of the adhesive 35. Subsequently, via the mask film 51 patterned to a predetermined shape, the channel substrate 10 is anisotropically etched so as to form the pressure generation chambers 12, etc.

EMBODIMENT 3

Figure 12:
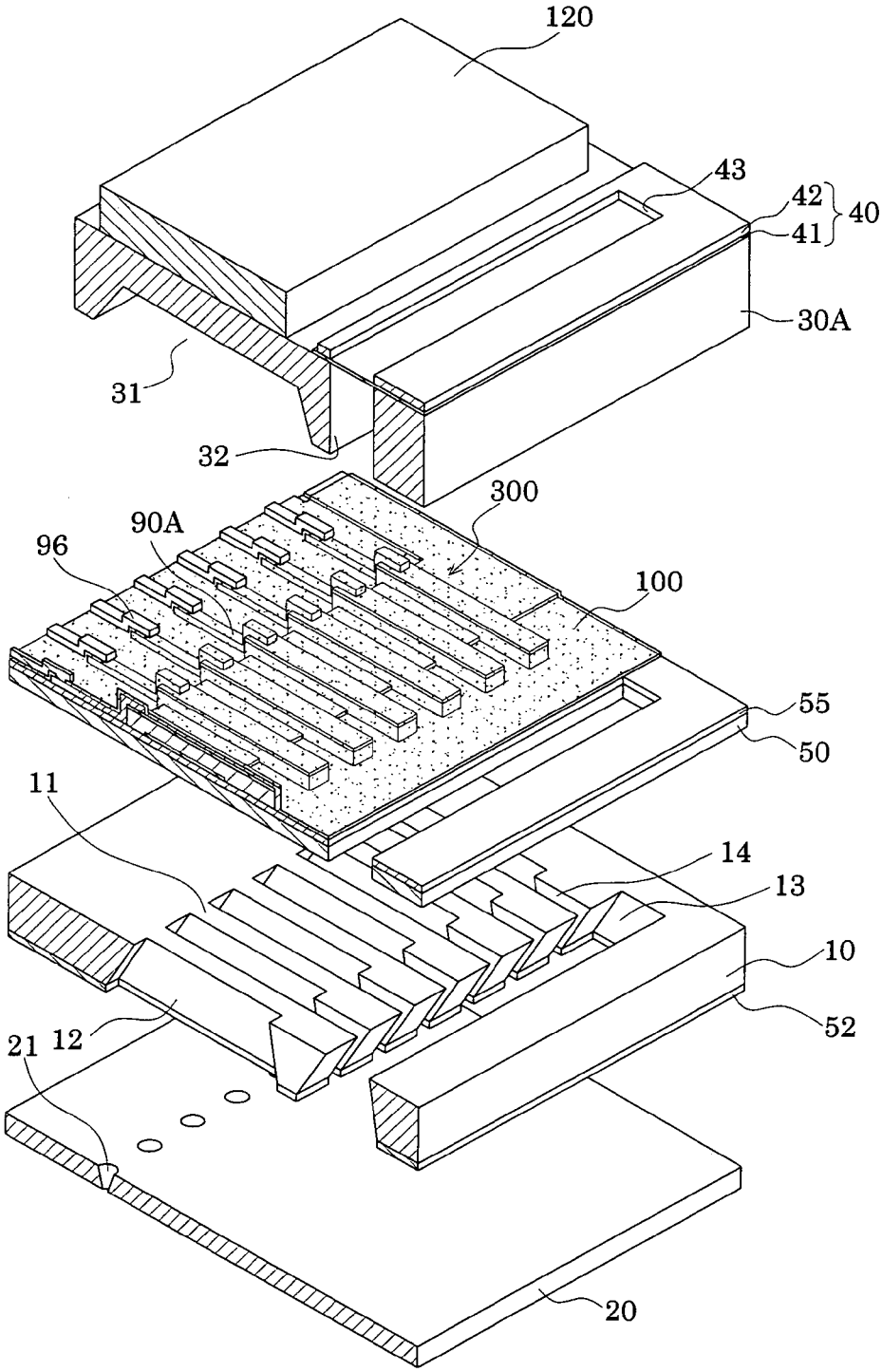
FIG. 12 is a schematic perspective view of a recording head according to Embodiment 3.
Figure 13:
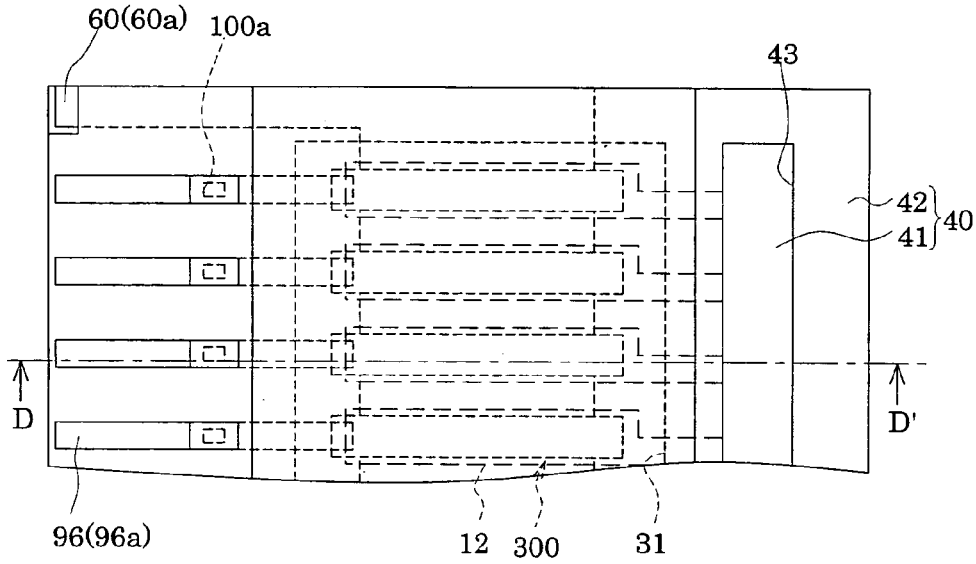
FIGS. 13A-13B show plan and sectional views of the recording head according to Embodiment 3.
Figure 13:
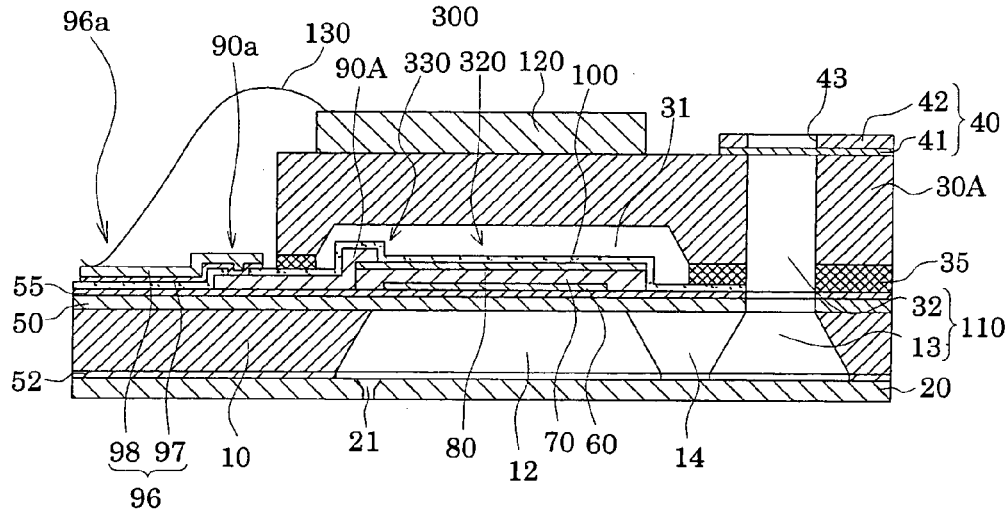
Figure 14:
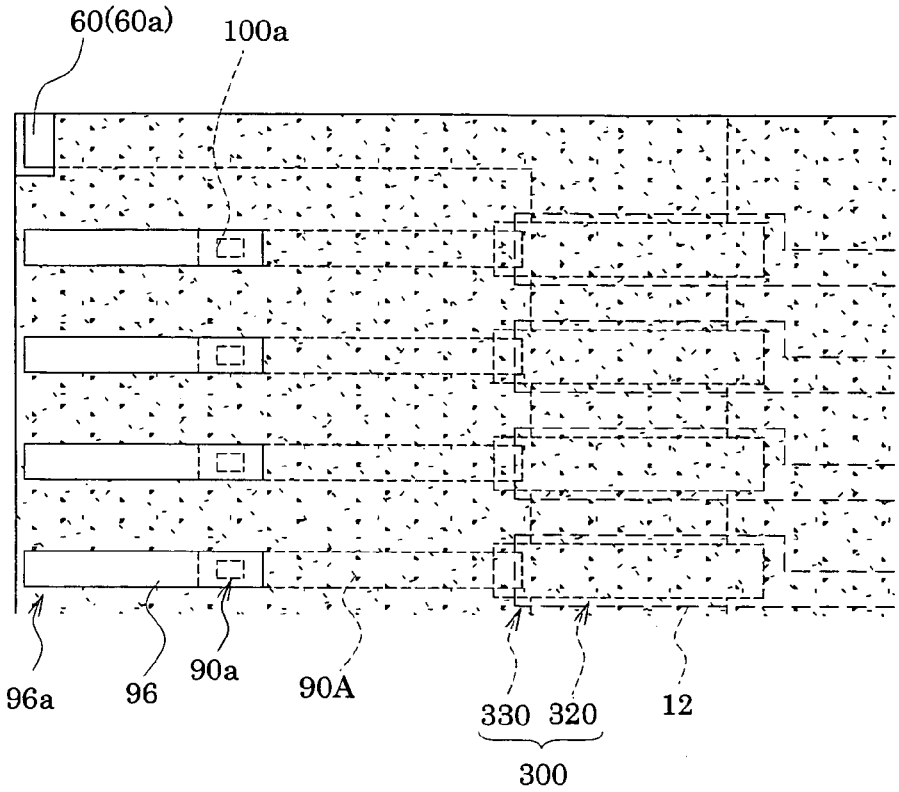
FIG. 14 is a plan view showing a main portion of the recording head according to Embodiment 3.

FIG. 12 is a schematic perspective view of an ink-jet recording head according to Embodiment 3; and FIG. 13 shows plan and sectional views of the ink-jet recording head. FIG. 14 is a plan view showing a main portion of the ink-jet recording head.

In the present embodiment, second upper-electrode lead electrodes 96, which constitute a portion of the connection wiring, are further provided. As shown in FIGS. 12 to 14, a lower electrode film 60 is formed in a region facing pressure generation chambers 12 with respect to the longitudinal direction of the pressure generation chambers 12 and extends continuously through respective regions corresponding to the plurality of pressure generation chambers 12. Further, at a location outside the row of the pressure generation chambers 12, the lower electrode film 60 extends to the vicinity of the end portion of the channel substrate 10, and the end portion of the extension serves as a connection portion 60*a*, to which connection wiring 130, which extends from a drive IC 120 to be described later, is connected. Piezoelectric layer 70 and upper electrode films 80 are basically provided within respective regions facing the pressure generation chambers 12. However, with respect to the longitudinal direction of the pressure generation chambers 12, they extend beyond the end portion of the lower electrode film 60, and the end surface of the lower electrode film 60 is covered by the piezoelectric layers 70. A piezoelectric non-active portion 330, which includes the piezoelectric layer 70 but is not substantially driven, is formed in the vicinity of the longitudinal end of each pressure generation chamber 12. Further, upper-electrode lead electrodes 90A formed of, for example, a material which contains aluminum as a predominant component are connected to ends of the upper electrode films 80 of the piezoelectric element 300. In the present embodiment, the upper-electrode lead electrodes 90A extend from a region on the piezoelectric non-active portions 330, located outside the pressure generation chambers 12, to a region on the insulating film 55.

Further, the second upper-electrode lead electrodes 96 are connected to the upper-electrode lead electrodes 90A via an insulating film 100 formed of an inorganic insulating material. The second upper-electrode lead electrodes 96 extend to the vicinity of the end portion of the channel substrate 10. As in the case of the connection portion 60*a* of the lower electrode film 60, tip end portions of the second upper-electrode lead electrodes 96 serves as terminal portions 96*a*, to which the drive wiring 130 is connected.

In the present embodiment, the insulating film 100 is provided in the pattern regions of the constituent layers of piezoelectric elements 300, the upper-electrode lead electrodes 90A, and the second upper-electrode lead electrodes 96. At least the piezoelectric elements 300 and the upper-electrode lead electrodes 90A are covered with the insulating film 100, except for the connection portions 90*a* of the upper-electrode lead electrodes 90A. For example, in the present embodiment, the insulating film 100 is continuously formed to cover the lower electrode film 60 outside the row of the piezoelectric elements 300, so that the lower electrode film 60, together with the piezoelectric elements 300 and the upper-electrode lead electrodes 90A, is covered with the insulating film 100, except for the connection portion 60*a*.

As described above, the insulating film 100 is continuously formed to the pattern region of the second upper-electrode lead electrodes 96. That is, the insulating film 100 is continuously formed to the vicinity of the end portion of the channel substrate 10, and the terminal portions 96*a* of the second upper-electrode lead electrodes 96 are located above the insulating film 100.

As described above, the surfaces of the piezoelectric elements 300 and the upper-electrode lead electrodes 90A are covered with the insulating film 100, and the terminal portions 96*a*, to which the drive wiring 130 is connected, are provided on the second upper-electrode lead electrodes 96 provided on the insulating film 100. Thus, breakage of the piezoelectric layer 70 due to water (moisture) can be reliably prevented. That is, the piezoelectric elements 300 and the upper-electrode lead electrodes 90A (except for the connection portions 90*a*) are covered with the insulating film 100, which continuously extends to the pattern region of the second upper-electrode lead electrodes 96. Further, the connection portions 90*a* of the upper-electrode lead electrodes 90A are covered by the second upper-electrode lead electrodes 96. Accordingly, water can enter only from the end portion of the insulating film 100, and even when water enters, the water is substantially prevented from reaching the piezoelectric layer 70, whereby breakage of the piezoelectric layer 70 due to water can be prevented more reliably.

Further, since the insulating film 100 is provided under the terminal portions 96*a* of the second upper-electrode lead electrodes 96, to which the drive wiring 130 is connected, there can be attained an effect of increasing the degree of adhesion of the second upper-electrode lead electrodes 96. This prevents occurrence of failures such as exfoliation of the second upper-electrode lead electrodes 96, which exfoliation would otherwise occur when the drive wiring 130 is connected to the second upper-electrode lead electrodes 96 by means of wire bonding or the like.

Figure 15:
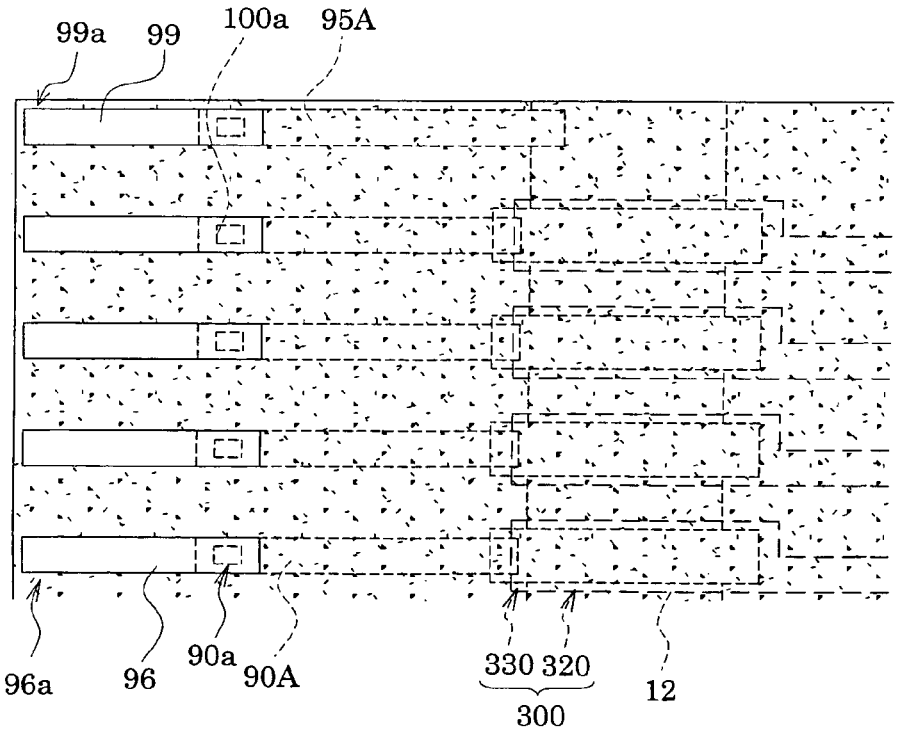
FIG. 15 is a plan view showing a modification of the recording head according to Embodiment 3.

In the present embodiment, the end portion of the extension of the lower electrode film 60, which extends to the vicinity of the communication section 13, serves as the connection portion 60*a* for connection with the connection wring 130. However, for example, a configuration as shown in FIG. 15 may be employed. Specifically, a lower-electrode lead electrode 95A, which is electrically connected to the lower electrode film 60, is provided outside the row of the piezoelectric elements 300 such that the lower-electrode lead electrode 95A extends to a region outside the piezoelectric elements 300 with respect to the longitudinal direction thereof. A second lower-electrode lead electrode 99 is provided such that it extends to the vicinity of the end portion of the channel substrate 10, and a tip end portion of the second lower-electrode lead electrode 99 is used as a terminal portion 99*a*, to which the drive wiring 130 is connected. In this case, the pattern regions of the constituent layers of the piezoelectric elements 300, the upper-electrode lead electrodes 90A, and the lower-electrode lead electrode 95A, the second upper-electrode lead electrode 96, and the second lower-electrode lead electrode 99 are covered with the insulating film 100, except for the connection portions 90*a* and 95*a* of the upper and lower-electrode lead electrodes 90A and 95A.

Figure 16:
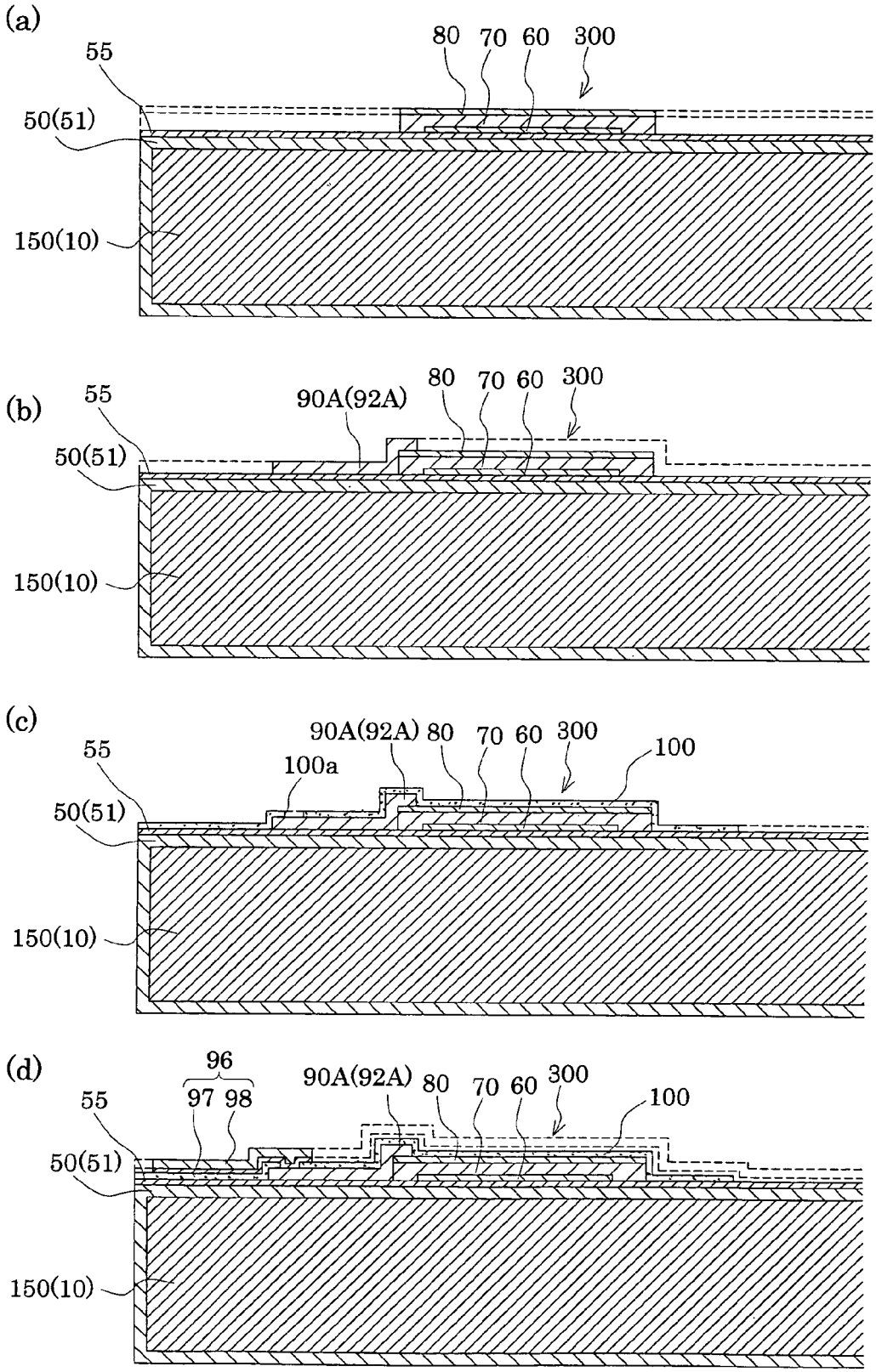
FIGS. 16A-16D are sets of sectional views showing steps of manufacturing the recording head according to Embodiment 3.
Figure 17:
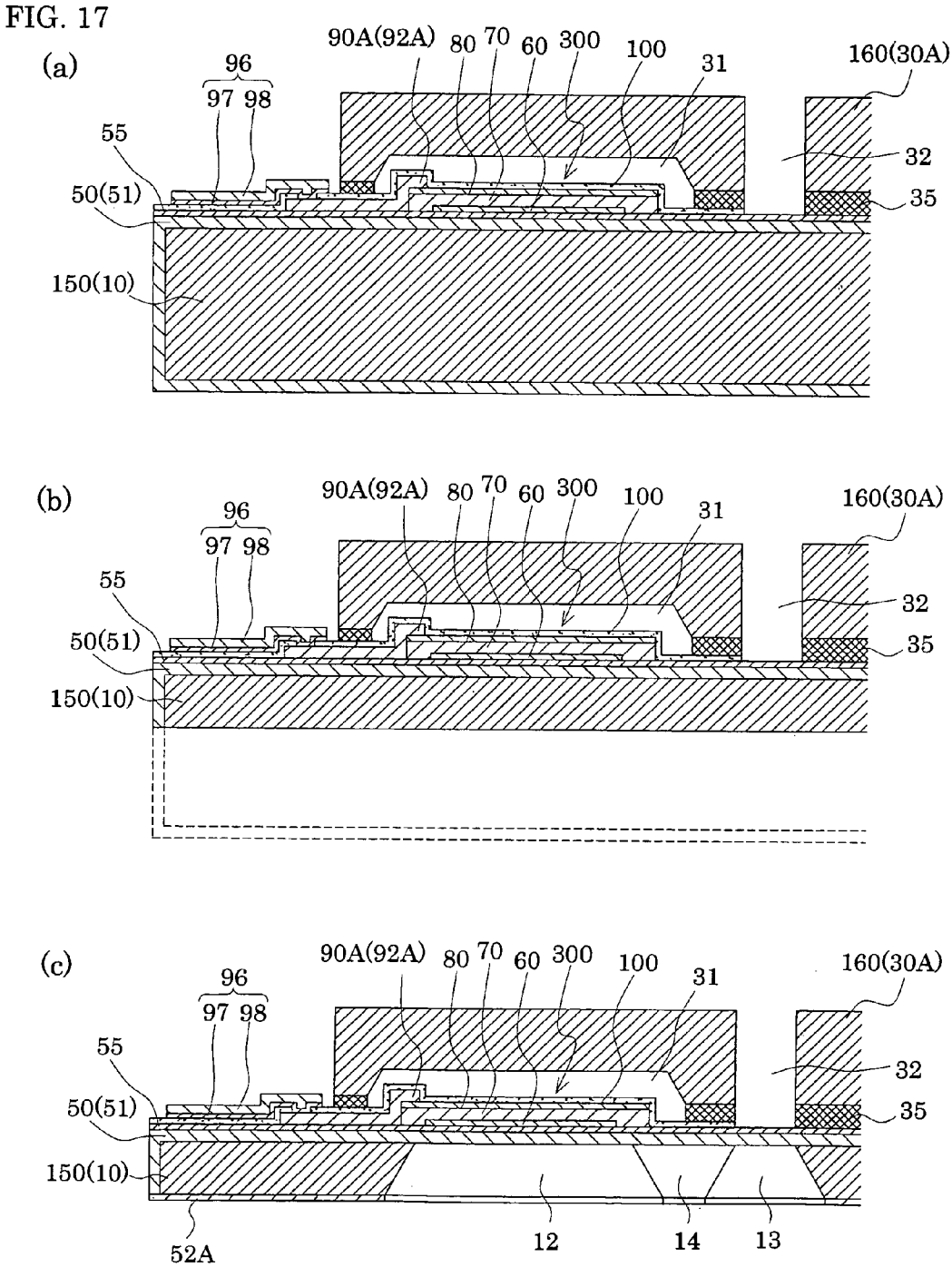
FIGS. 17A-17C are sets of sectional views showing steps of manufacturing the recording head according to Embodiment 3.

A method for manufacturing the ink-jet recording head according to the present embodiment will be described. FIGS. 16 and 17 show sectional views taken along the longitudinal direction of the pressure generation chambers 12. As described above, ink-jet recording heads are manufactured in such a manner that a large number of chips are simultaneously formed on a single wafer, and the wafer is then diced into chips each corresponding to a channel substrate 10 as shown in FIG. 1. In the present embodiment, a method for manufacturing the ink-jet recording head by actually using a channel substrate wafer 150, which is a silicon wafer.

First, as shown in FIG. 16(*a*), the elastic film 50 and the insulating film 55 are formed on the channel substrate wafer 150 (channel substrate 10), which is a silicon wafer having a relatively large thickness of about 625 μm and high rigidity. Subsequently, the piezoelectric elements 300, each composed of the lower electrode film 60, the piezoelectric layer 70, and the upper electrode film 80, are formed on the insulating film 55. The methods for forming the elastic film 50, the insulating film 55, and the piezoelectric elements 300 are identical to those in Embodiment 1 (see FIGS. 5(*a*) to 5(*d*)).

Next, as shown in FIG. 16(*b*), the upper-electrode lead electrodes 90A are formed. Specifically, a metal layer 92A formed of a predetermined metal material (aluminum (Al) in the present embodiment) is formed over the entire surface of the channel substrate wafer 150. After that, the metal layer 92A is patterned for each piezoelectric element 300 via a mask pattern (not shown) formed of resist or the like, whereby the upper-electrode lead electrodes 90A are formed.

Next, as shown in FIG. 16(*c*), the insulating film 100 of aluminum oxide ($Al_2O_3$) is formed, and is then patterned to a predetermined shape. Specifically, the insulating film 100 is formed over the entire surface of the channel substrate wafer 150. Subsequently, the insulating film 100 is removed from regions corresponding to the connection portion 60*a* of the lower electrode film 60 and the connection portions 90*a* of the upper-electrode lead electrodes 90A, whereby openings 100*a* are formed. Notably, in the present embodiment, the insulating film 100 is removed from regions corresponding to the connection portions 60*a* and 90*a*, and from the remaining region except for the pattern regions of the constituting layers of the piezoelectric elements 300, the upper-electrode lead electrodes 90A, and the second upper-electrode lead electrodes 96 formed in a step to be described later. Needless to say, the insulating film 100 may be removed only from the regions corresponding to the connection portions 60*a* and 90*a*.

Next, the second upper-electrode lead electrodes 96 are formed. For example, in the present embodiment, as shown in FIG. 16(*d*), a close contact layer 97 formed of, for example, titanium tungsten (TiW) is formed over the entire surface of the channel substrate wafer 150, and a metal layer 98 formed of, for example, gold (Au) is formed over the entire surface of the close contact layer 97. After that, the metal layer 98 is patterned for each piezoelectric element 300 via a mask pattern (not shown), and the close contact layer 97 is patterned through etching, whereby the second upper-electrode lead electrodes 96 are formed.

Next, as shown in FIG. 17(*a*), a protective plate wafer 160, which is a silicon wafer and is to become a plurality of protective plates 30 is bonded to the channel substrate wafer 150 on the side toward the piezoelectric elements 300. Notably, since this protective plate wafer 160 has thickness of, for example, about 625 μm, the rigidity of the channel substrate wafer 150 greatly increases as a result of boding of the protective plate wafer 160.

Subsequently, as shown in FIG. 17(*b*), in the present embodiment, the channel substrate wafer 150 is polished until the thickness of the channel substrate wafer 150 decreases to a certain level. Further, the channel substrate wafer 150 is wet-etched by use of an aqueous solution containing fluoric acid and nitric acid such that the channel substrate wafer 150 has a predetermined thickness. For example, in the present embodiment, the channel substrate wafer 150 was etched such that the channel substrate wafer 150 has a thinness of about 70 μm.

After that, as shown in FIG. 17(*c*), a mask film 52A formed of, for example, silicon nitride is newly formed on the channel substrate wafer 150, and is patterned into a predetermined shape. The pressure generation chambers 12, the communication sections 13, the ink supply passages 14, etc. are formed in the channel substrate wafer 150 by anisotropically etching the channel substrate wafer 150 via the mask film 52A.

After that, unnecessary portions of the outer circumferential edges of the channel substrate wafer 150 and the protective plate wafer 160 are removed by cutting them by means of dicing or the like. Subsequently, the nozzle plate 20 having the nozzle orifices 21 formed therein is bonded to the surface of the channel substrate wafer 150 opposite the protective plate wafer 160, and the compliance substrate 40 is bonded to the protective plate wafer 160. Subsequently, the channel substrate wafer 150, etc. are diced into chips each corresponding to the channel substrate 10 as shown in FIG. 1. Thus, the ink-jet recording head of the present embedment is completed.

EMBODIMENT 4

Figure 18:
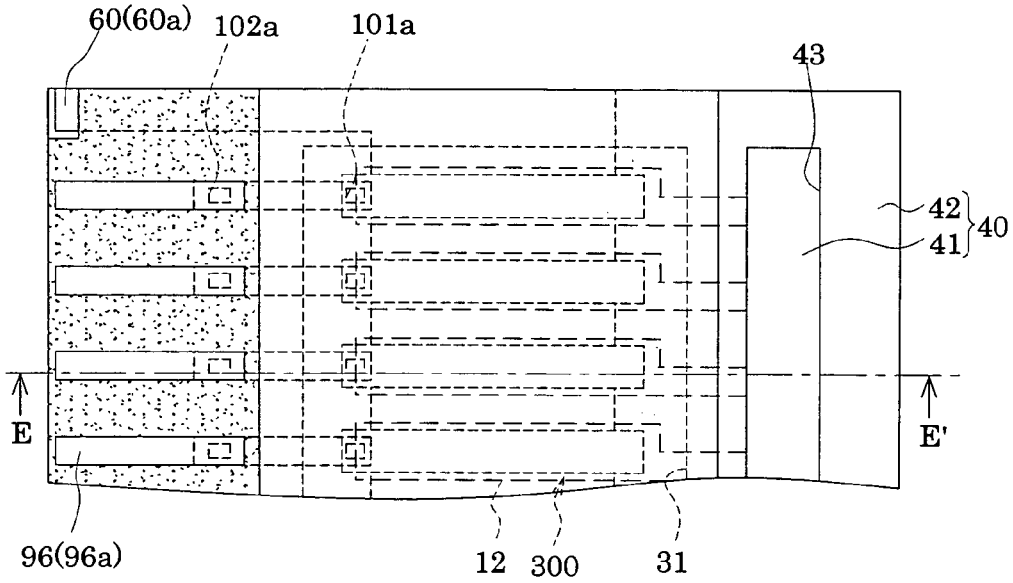
FIGS. 18A-18B show plan and sectional views of the recording head according to Embodiment 4.
Figure 18:
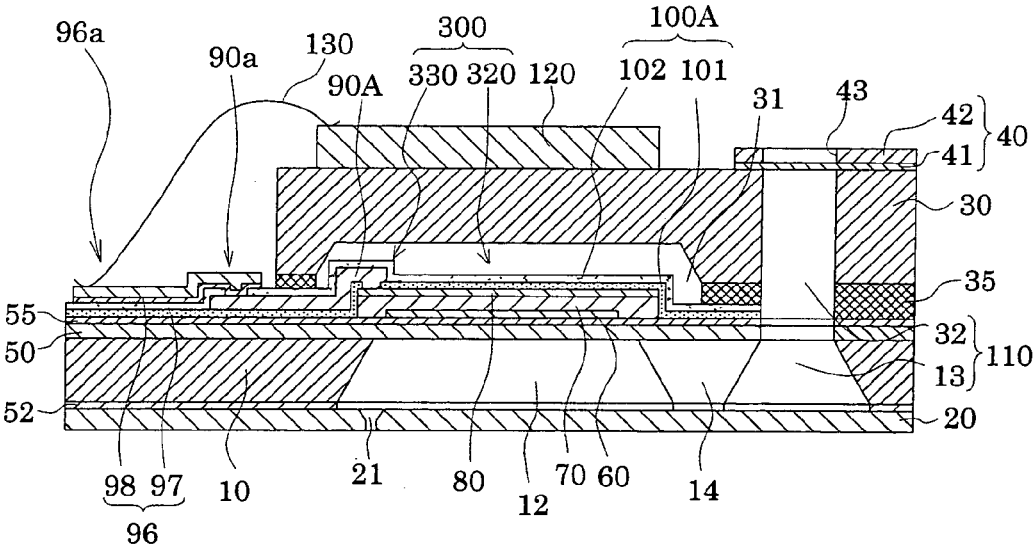

FIG. 18 is a pair of sectional views of an ink-jet recording head according to Embodiment 4. The present embodiment is an example in which in the structure of Embodiment 3, the piezoelectric elements 300 are covered with the insulating film 100A composed of the first insulating film 101 and the second insulating film 102 as in Embodiment 2. That is, in the present embodiment, as shown in FIG. 18, the upper-electrode lead electrodes 90A are provided on the first insulating film 101 to extend therealong, and are connected to the upper electrode films 80 via the connection holes 101*a* of the first insulating film 101. Further, the pattern regions of the upper-electrode lead electrodes 90A, and the constituent layers of the piezoelectric elements 300 are covered with the second insulating film 102, except for regions facing the connection portions 90*a* of the upper-electrode lead electrodes 90A. The second insulating film 102 is further formed on the first insulating film 101, whereby the piezoelectric elements 300 are covered with the first and second insulating film 101 and 102. Further, the second upper-electrode lead electrodes 96 are formed on the second insulating film 102, and are connected to the first upper-electrode lead electrodes 90A via the openings 102*a* of the second insulating film 102.

In such a configuration, the piezoelectric elements 300 are covered with the first and second insulating film 101 and 102, whereby the piezoelectric layers 70 are prevented from contacting water (moisture). Accordingly, breakage of the piezoelectric layers 70 due to water (moisture) can be prevented more reliably.

EMBODIMENT 5

Figure 19:
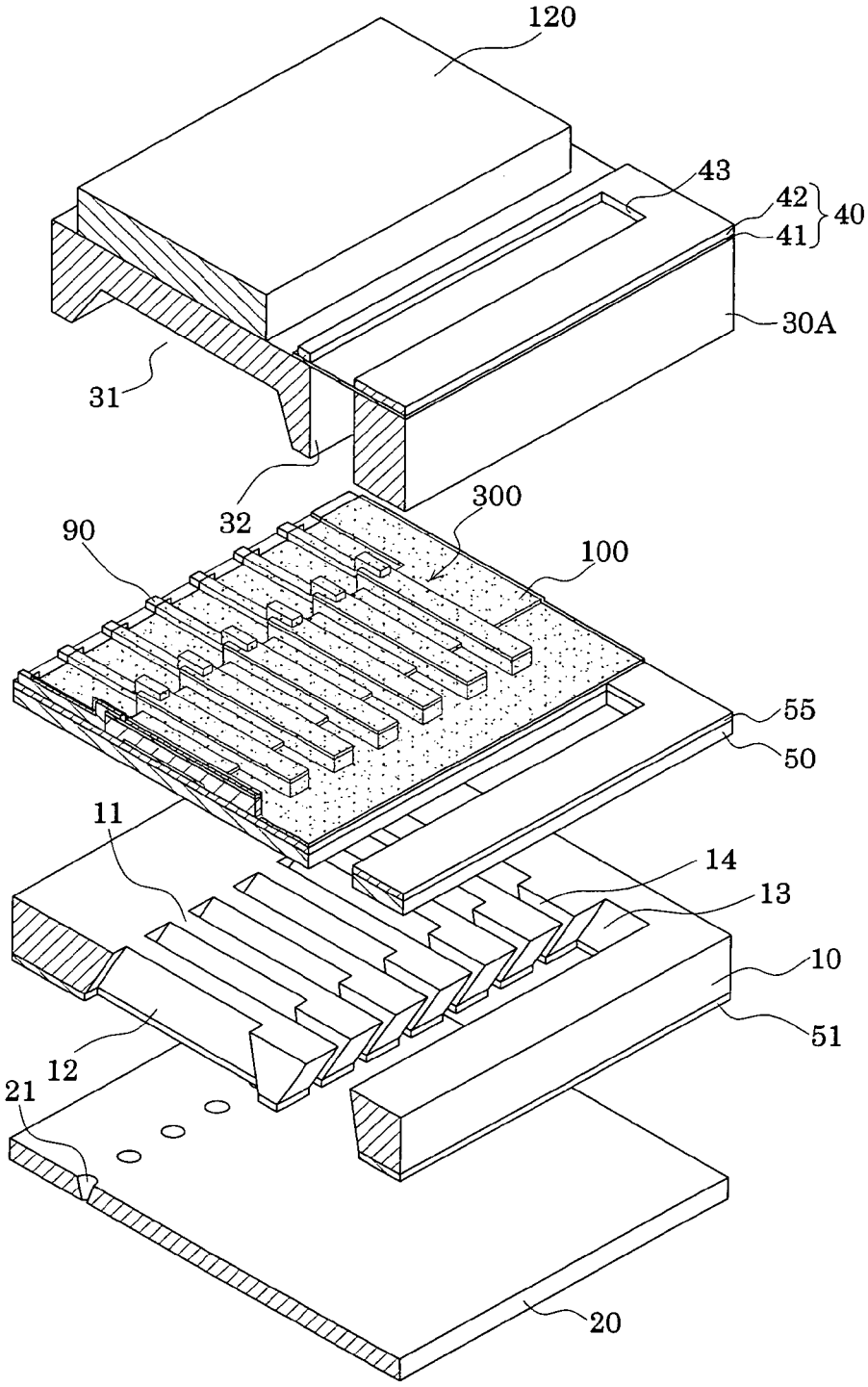
FIG. 19 is a schematic perspective view of a recording head according to Embodiment 5.
Figure 20:
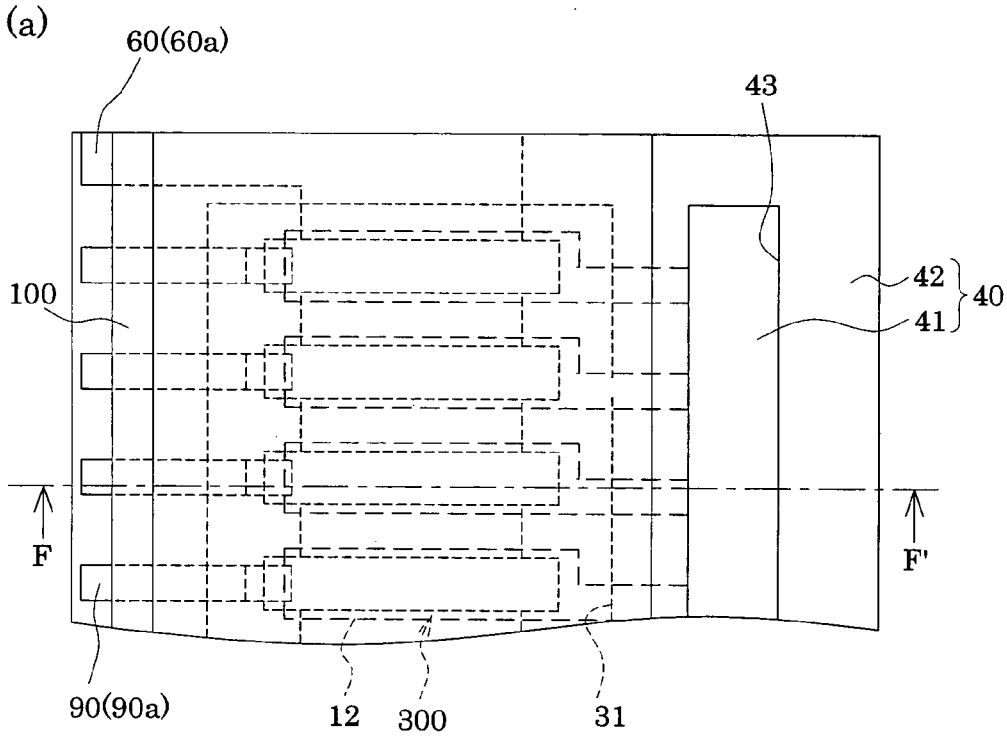
FIGS. 20A-20B show plan and sectional views of the recording head according to Embodiment 5.
Figure 20:
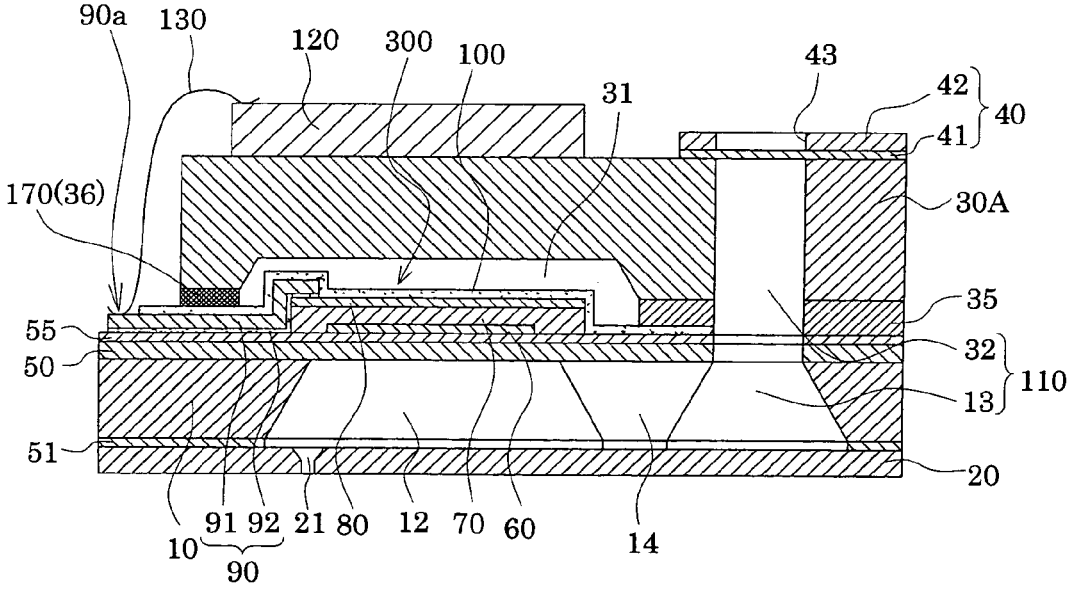

FIG. 19 is an exploded perspective view of an ink-jet recording head according to Embodiment 5. FIG. 20 shows plan and sectional views of the recording head.

The present embodiment is an example in which a moisture permeable portion formed of a material through which water within the piezoelectric-element-holding portion can permeate is provided at a portion of a bonding surface of the protective plate, which surface is bonded to the channel substrate. The present embodiment is identical to Embodiment 1, except that the upper-electrode lead electrodes are formed to extend to the vicinity of the end portion of the channel substrate, the drive wiring is connected to the upper-electrode lead electrodes outside the protective plate and a through portion is not provided in the protective plate.

Specifically, as shown in FIGS. 19 and 20, a moisture permeable portion 170, which is formed of a material through which water within the piezoelectric-element-holding portion 31, can permeate is provided at a portion of a bonding surface of the protective plate 30A, which surface is bonded to the channel substrate 10, specifically, in a portion of a region surrounding the piezoelectric-element-holding portion 31 except for a region located on the side toward the reservoir 110. For example, the moisture permeable portion 170 is formed of an adhesive layer 36 formed of an adhesive having a water permeability higher than that of the adhesive that forms the adhesive layer 35, and as shown in FIG. 20, is provided in a region of the piezoelectric-element-holding portion 31 opposite the reservoir 110. Notably, the moisture permeable portion 170 (the adhesive layer 36) also plays a role of bonding the protective plate 30 and the channel substrate 10 together.

Since the moisture permeable portion 170 is provided, water (moisture) having entered the piezoelectric-element-holding portion 31 is discharged to the outside via the moisture permeable portion 170. Accordingly, the interior of the piezoelectric-element-holding portion 31 is maintained at a relatively low humidity, whereby breakage of the piezoelectric elements 300 due to water can be prevented. Specifically, since the reservoir 110 is provided adjacent to the piezoelectric-element-holding portion 31, water of ink stored in the reservoir 110 enters the piezoelectric-element-holding portion 31 via the adhesive layer 35 in a region of the piezoelectric-element-holding portion 31 on the reservoir 110 side. Therefore, humidity within the piezoelectric-element-holding portion 31 increases gradually, and in some cases, the humidity within the piezoelectric-element-holding portion 31 increases to about 85%. Even when an adhesive having a low water permeability is used for forming the adhesive layer 35, such entry of water of ink into the piezoelectric-element-holding portion 31 cannot be prevented completely.

However, since the moisture permeable portion 170 is provided, even when water enters the piezoelectric-element-holding portion 31 via the adhesive layer 35 in the region of the piezoelectric-element-holding portion 31 on the reservoir 110 side, water within the piezoelectric-element-holding portion 31 is discharged to the outside via the moisture permeable portion 170 if the humidity within the piezoelectric-element-holding portion 31 is higher than the outside humidity. Accordingly, the humidity within the piezoelectric-element-holding portion 31 is always suppressed to the humidity of outside air or lower.

Since the surfaces of the upper-electrode lead electrodes 90 and the constituent layers of the piezoelectric elements 300 sealed within the piezoelectric-element-holding portion 31 are covered with the insulating film 100 formed of an inorganic insulating material, if the humidity within the piezoelectric-element-holding portion 31 is suppressed to a level close to the humidity of outside air, the piezoelectric elements are not broken by water (moisture) within the piezoelectric-element-holding portion 31. Accordingly, an ink-jet recording head whose piezoelectric elements 300 have considerably improved durability can be realized.

Figure 21:
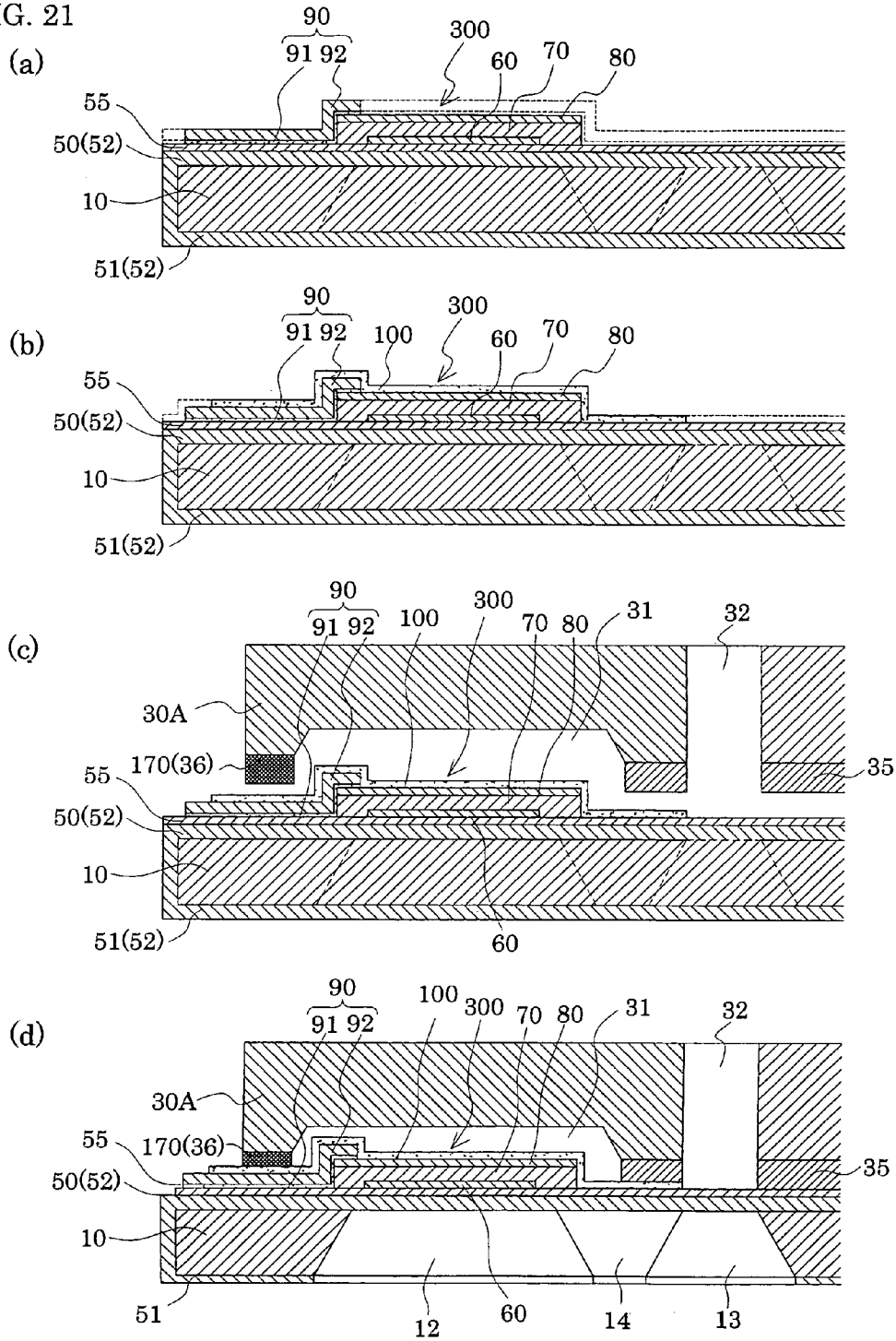
FIGS. 21A-21D are sets of sectional views showing steps of manufacturing the recording head according to Embodiment 5.

A method for manufacturing the ink-jet recording head according to the present embodiment will be described. FIG. 21 shows sectional views taken along the longitudinal direction of the pressure generation chambers 12. First, as described in Embodiment 1, the elastic film 50 and the insulating film 55 are formed on the channel substrate 10, and the piezoelectric elements 300, each composed of the lower electrode film 60, the piezoelectric layer 70, and the upper electrode film 80, are formed on the insulating film 55 (see FIGS. 5(*a*) to 6(*a*)).

Next, as shown in FIG. 21(*a*), a close contact layer 91 and a metal layer 92 are successively formed, and then patterned to thereby form the upper-electrode lead electrodes 90. Subsequently, as shown in FIG. 21(*b*), the insulating film 100 of, for example, aluminum oxide ($Al_2O_3$) is formed.

Next, as shown in FIG. 21(*c*), the protective plate 30 is bonded to the channel substrate 10 on the side toward the piezoelectric elements 300 via the adhesive layer 35, and the moisture permeable portion 170 is formed. That is, the adhesive layer 35 is formed except for a peripheral edge region of the piezoelectric-element-holding portion 31 of the protective plate 30, the region being located opposite the reservoir section 32. The adhesive layer 36 having higher water permeability as compared with the adhesive layer 35 is formed in the region located opposite the reservoir section 32. The protective plate 30 is bonded to the channel substrate 10 via these adhesive layers 35 and 36. Thus, the moisture permeable portion 170 composed of the adhesive layer 36 is formed in the peripheral edge region of the piezoelectric-element-holding portion 31 opposite the reservoir 110.

After that, as shown in FIG. 21(*d*), the pressure generation chambers 12, etc. are formed by anisotropically etching the channel substrate 10 via the mask film 51 patterned to a desired shaped.

EMBODIMENT 6

Figure 22:
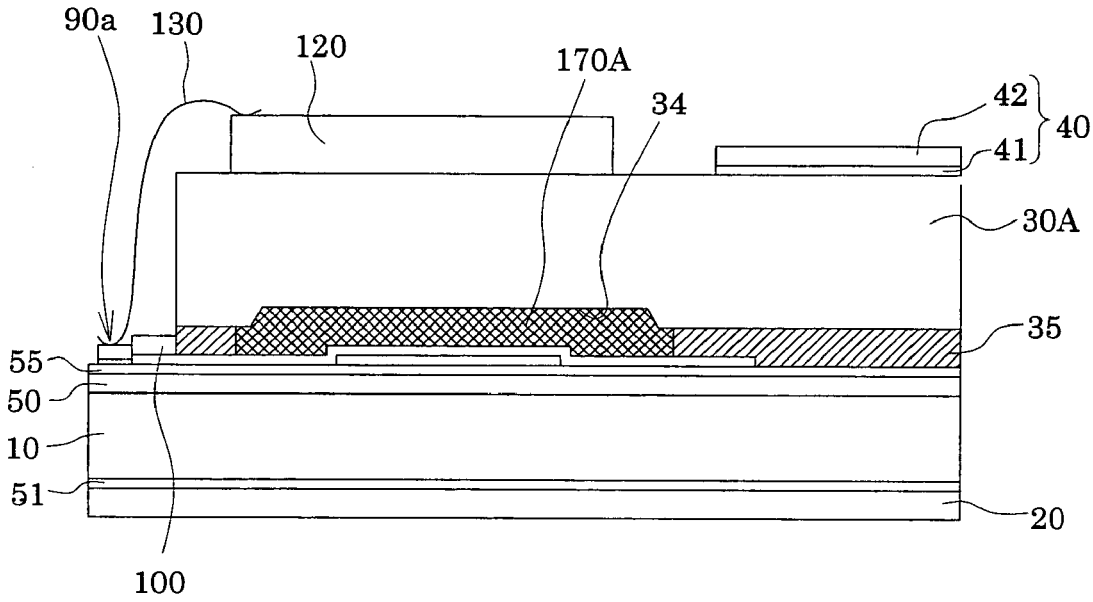
FIG. 22 is a side view of a recording head according to Embodiment 6.

FIG. 22 is a side view of an ink-jet recording head according to Embodiment 6. The present embodiment is an example in which a moisture permeable portion 170A is provided in the protective plate 30A in regions outside the opposite end portions of the row of the pressure generation chambers 12. That is, in the present embodiment, as shown in FIG. 22, portions of the protective plate 30 corresponding to the regions outside the opposite end portions of the row of the pressure generation chambers 12 are removed by means of half etching so as to form a recessed portion 34. This recessed portion 34 is sealed with a potting material, whereby the moisture permeable portion 170A is formed.

In this structure as well, as in the case of Embodiment 5, water within the piezoelectric-element-holding portion 31 is discharged to the outside via the moisture permeable portion 170A, and the humidity within the piezoelectric-element-holding portion 31 is maintained at a level close to the outside humidity. Accordingly, breakage of the piezoelectric elements 300 stemming from water can be prevented for a long period of time.

OTHER EMBODIMENTS

In the above, various embodiments of the present invention have been described. However, the present invention is not limited to the above-described embodiments. For example, in the above-described Embodiments 1 to 4, the piezoelectric elements are formed within the piezoelectric-element-holding portion. However, the present invention is not limited thereto, and, needless to say, the piezoelectric elements may be exposed. In this case as well, since the surfaces of the piezoelectric elements and the upper-electrode lead electrodes, etc. are covered with an insulating film formed of an inorganic insulating material, breakage of the piezoelectric layer stemming from water (moisture) can be reliably prevented. Further, for example, in Embodiments 5 and 6, the moisture permeable portion 170 is provided at a joint surface of the protective plate 30, which joined to the channel substrate 10. However, the present invention is not limited thereto, and, for example, there can be employed a structure in which a communication hole communicating the piezoelectric-element-holding portion 31 is provided on the upper surface of the protective plate 30 or the like, and the communication hole is sealed with an organic material such as an adhesive having high water permeability, whereby a moisture permeable portion is formed.

Figure 23:
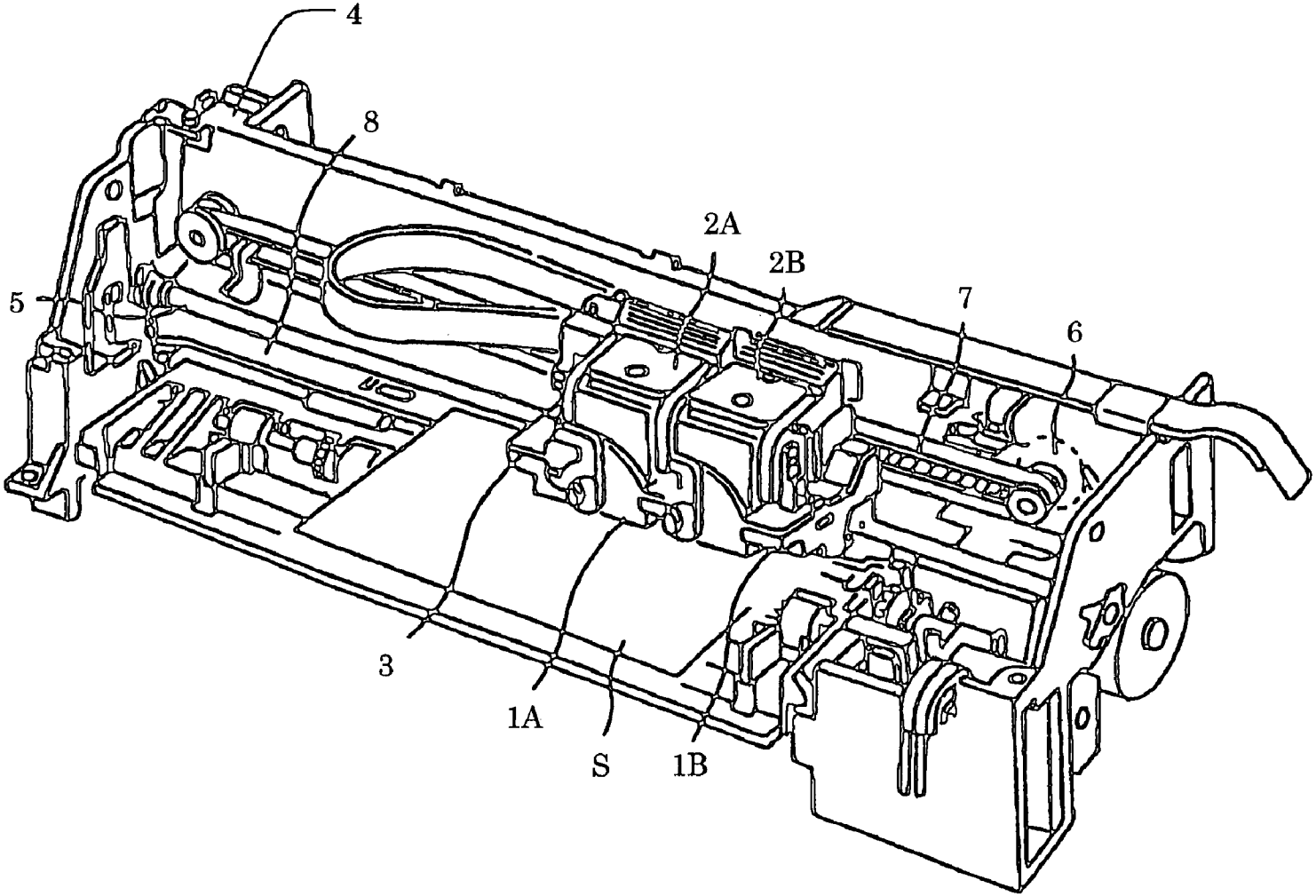
FIG. 23 is a schematic view of a recording apparatus according to one embodiment.

Each of the ink-jet recording heads of the above embodiments partially constitutes a recording head unit, which includes an ink channel communicating with an ink cartridge or a like device, to thereby be mounted on an ink-jet recording apparatus. FIG. 23 schematically shows an example of such an ink-jet recording apparatus. As shown in FIG. 23, recording head units 1A and 1B each including an ink-jet recording head removably carry cartridges 2A and 2B, respectively. The cartridges 2A and 2B serve as ink supply means. A carriage 3 that carries the recording head units 1A and 1B is mounted, in an axially movable condition, on a carriage shaft 5, which is attached to an apparatus body 4. The recording head units 1A and 1B are adapted to discharge, for example, a black ink composition and a color ink composition, respectively. Driving force of a drive motor 6 is transmitted to the carriage 3 via a plurality of unillustrated gears and a timing belt 7, whereby the carriage 3, which carries the recording head units 1A and 1B, is moved along the carriage shaft 5. A platen 8 is provided on the apparatus body 4 in such a manner as to extend along the carriage shaft 5. A recording sheet S is fed onto the platen 8. The recording sheet S is, for example, paper, which is fed by means of unillustrated paper feed rollers.

In the above-described embodiments, the present invention has been described while mentioning an ink-jet recording head for discharging ink as a liquid-jet head. However, the basic structure of the liquid-jet head is not limited to those described above. The present invention is intended for application to various liquid-jet heads, and can be applied to those which discharge liquid other than ink. Examples of other liquid-jet heads include a recording head for use in image recording apparatus such as printers; a head for discharging liquid that contains color materials for use in manufacture of color filters for liquid crystal displays and the like; a head for discharging liquid that contains electrode materials for use in manufacture of electrodes for organic EL displays, FEDs (field emission displays), and the like; and a head for discharging liquid that contains, bioorganic compounds for use in manufacture of biochips.

The invention claimed is:

1. A liquid-jet head comprising:

a channel substrate which has pressure generation chambers formed therein and communicating nozzle orifices for discharging liquid droplets; and piezoelectric elements each of which is composed of a lower electrode, a piezoelectric layer, and an upper electrode and which are disposed on one surface of the channel substrate via a vibration plate, wherein at least pattern regions of the respective layers which constitute the piezoelectric elements are covered with an insulating film, and wherein the sum of stress of the insulating film and stress of the upper electrode is compressive.

2. The liquid-jet head according to claim 1, wherein stress of the insulating film and stress of the upper electrode are each compressive.

3. The liquid-jet head according to claim 2, wherein the upper electrode is formed of at least Pt.

4. A liquid-jet apparatus characterized by comprising the liquid-jet head according to claim 3.

5. A liquid-jet apparatus characterized by comprising the liquid-jet head according to claim 2.

6. The liquid-jet head according to claim 1, wherein stress of the insulating film is compressive, and stress of the upper electrode is tensile.

7. The liquid-jet head according to claim 6, wherein the upper electrode is formed of at least Ir.

8. A liquid-jet apparatus characterized by comprising the liquid-jet head according to claim 7.

9. The liquid-jet head according to claim 6, wherein stress δ of the upper electrode and that of the insulating film are each represented by the product (ϵ×Y×m) of Young's modulus of elasticity Y, distortion ϵ, and film thickness m, and stress $\delta_1$ of the upper electrode and stress $\delta_2$ of the insulating film satisfy the condition $|\delta_1|<|\delta_2|$.

10. A liquid-jet apparatus characterized by comprising the liquid-jet head according to claim 9.

11. A liquid-jet apparatus characterized by comprising the liquid-jet head according to claim 6.

12. The liquid-jet head according to claim 1, wherein a protective plate having a piezoelectric-element-holding portion, which is a space for protecting the piezoelectric elements, is bonded to a surface of the channel substrate via an adhesive layer, the surface being located on the side toward the piezoelectric elements, the protective plate includes a flow passage for liquid to be supplied to the pressure generation chambers, the adhesive layer located on the flow passage side of the piezoelectric-element-holding portion is exposed to the interior of the flow passage, and a moisture permeable portion which enables permeation of water within the piezoelectric-element-holding portion is provided in a region other than the flow passage side of the piezoelectric-element-holding portion.

13. The liquid-jet head according to claim 12, wherein the moisture permeable portion is formed of an organic material.

14. A liquid-jet apparatus characterized by comprising the liquid-jet head according to claim 13.

15. The liquid-jet head according to claim 12, wherein the moisture permeable portion is provided on a portion of a bonding surface of the protective plate, the bonding surface being bonded to the channel substrate.

16. The liquid-jet head according to claim 15, wherein the moisture permeable portion is formed of an adhesive having a water permeability higher than that of an adhesive which constitutes the adhesive layer.

17. A liquid-jet apparatus characterized by comprising the liquid-jet head according to claim 16.

18. A liquid-jet apparatus characterized by comprising the liquid-jet head according to claim 16.

19. The liquid-jet head according to claim 12, wherein the moisture permeable portion is provided on an upper surface of the protective plate.

20. A liquid-jet apparatus characterized by comprising the liquid-jet head according to claim 19.

21. The liquid-jet head according to claim 12, wherein the moisture permeable portion is formed of a potting material.

22. A liquid-jet apparatus characterized by comprising the liquid-jet head according to claim 21.

23. The liquid-jet head according to claim 12, wherein the moisture permeable portion is provided in a region on a side of the piezoelectric-element-holding portion opposite the flow passage.

24. A liquid-jet apparatus characterized by comprising the liquid-jet head according to claim 23.

25. The liquid-jet head according to claim 12, wherein the moisture permeable portion is provided on the protective plate in each of regions outside the opposite ends of the row of pressure generation chambers.

26. A liquid-jet apparatus characterized by comprising the liquid-jet head according to claim 25.

27. A liquid-jet apparatus characterized by comprising the liquid-jet head according to claim 12.

28. A liquid-jet apparatus characterized by comprising the liquid-jet head according to claim 1.

29. The liquid-jet head according to claim 1, wherein the insulating film is formed of an inorganic amorphous material.

30. A liquid-jet head comprising:

a channel substrate which has pressure generation chambers formed therein and communicating nozzle orifices for discharging liquid droplets; and piezoelectric elements each of which is composed of a lower electrode, a piezoelectric layer, and an upper electrode and which are disposed on one surface of the channel substrate via a vibration plate, and an upper-electrode lead electrode extending from the upper electrode, wherein at least pattern regions of the respective layers which constitute the piezoelectric elements are covered with an insulating film, and wherein at least pattern regions of the respective layers which constitute the piezoelectric elements and the upper-electrode lead electrode are covered with the insulating film, except for regions facing connection portions of the lower electrode and the upper-electrode lead electrode, the connection portions being used for connection with connection wiring through which the piezoelectric elements are driven.

31. The liquid-jet head according to claim 30, wherein the upper-electrode lead electrode is formed of a material containing aluminum as a predominant component.

32. A liquid-jet apparatus characterized by comprising the liquid-jet head according to claim 31.

33. The liquid-jet head according to claim 30, further comprising a lower-electrode lead electrode extending from the lower electrode, wherein the lower electrode is connected to the connection wiring via the lower-electrode lead electrode, and the pattern region containing the lower-electrode lead electrode is covered with the insulating film, except for regions of the upper-electrode lead electrode and the lower-electrode lead electrode facing the connection wiring.

34. A liquid-jet apparatus characterized by comprising the liquid-jet head according to claim 33.

35. The liquid-jet head according to claim 30, wherein the upper electrode and the upper-electrode lead electrode are formed of different materials.

36. A liquid-jet apparatus characterized by comprising the liquid-jet head according to claim 35.

37. The liquid-jet head according to claim 30, wherein the piezoelectric layer and the upper electrode of each piezoelectric element extend to the outside of a region facing the corresponding pressure generation chamber so that a piezoelectric non-active portion is formed, and an end portion of the upper-electrode lead electrode on the side toward the upper electrode is located on the piezoelectric non-active portion and outside the pressure generation chamber.

38. A liquid-jet apparatus characterized by comprising the liquid-jet head according to claim 37.

39. The liquid-jet head according to claim 30, wherein in a state in which the connection wiring is connected, the connection portions are covered with a sealing material formed of an organic insulating material.

40. A liquid-jet apparatus characterized by comprising the liquid-jet head according to claim 39.

41. The liquid-jet head according to claim 30, wherein the insulating film includes a first insulating film and a second insulating film, the piezoelectric elements are covered by the first insulating film except for the connection portion for connection with the upper-electrode lead electrode, the upper-electrode lead electrode is provided on the first insulating film, and at least the pattern regions of the respective layers which constitute the piezoelectric elements and the upper-electrode lead electrode are covered with the second insulating film except for regions facing the connection portions.

42. A liquid-jet apparatus characterized by comprising the liquid-jet head according to claim 41.

43. The liquid-jet head according to claim 30, wherein the connection wiring includes a second upper-electrode lead electrode extending from the upper-electrode lead electrode, the second upper-electrode lead electrode is provided on the insulating film and is connected to the upper-electrode lead electrode at the connection portion, and a terminal portion to which drive wring is connected is provided at a tip end portion of the second upper-electrode lead electrode.

44. A liquid-jet apparatus characterized by comprising the liquid-jet head according to claim 43.

45. The liquid-jet head according to claim 30, wherein the piezoelectric layer and the upper electrode of each piezoelectric element extend to the outside of a region facing the corresponding pressure generation chamber so that a piezoelectric non-active portion is formed, and an upper-electrode-side end portion of the upper-electrode lead electrode which is connected to the upper electrode is located on the piezoelectric non-active portion and outside the pressure generation chamber.

46. A liquid-jet apparatus characterized by comprising the liquid-jet head according to claim 45.

47. The liquid-jet head according to claim 30, wherein a protective plate having a piezoelectric-element-holding portion, which is a space for protecting the piezoelectric elements, is bonded to a surface of the channel substrate, the surface being located on the side toward the piezoelectric elements, and the connection portion of the upper-electrode lead electrode is provided outside the piezoelectric-element-holding portion.

48. A liquid-jet apparatus characterized by comprising the liquid-jet head according to claim 47.

49. A liquid-jet apparatus characterized by comprising the liquid-jet head according to claim 30.

50. The liquid-jet head according to claim 30, wherein the insulating film is formed of an inorganic amorphous material.

51. A method of manufacturing a liquid-jet head, comprising:

forming piezoelectric elements, each of which is composed of a lower electrode, a piezoelectric layer, and an upper electrode, on one surface of a channel substrate via a vibration plate, the channel substrate having pressure generation chambers formed therein and communicating nozzle orifices for discharging liquid droplets;

forming an upper-electrode lead electrode extending from the upper electrode of each piezoelectric element;

forming an insulating film of an inorganic amorphous material over the entirety of a surface of the channel substrate, the surface facing the piezoelectric elements; and patterning the insulating film such that at least connection-wiring connection portions of the lower electrode and the upper-electrode lead electrode are exposed, and the insulating film is left in pattern regions of the respective layers of the piezoelectric elements and the upper-electrode lead electrode, except for the connection portion, wherein the method includes, after the patterning the insulating film, bonding a protective plate to a surface of the channel substrate, the surface facing the piezoelectric elements, the protective plate including a piezoelectric-element-holding portion for protecting the piezoelectric elements and a flow passage for liquid to be supplied to the pressure generation chambers, wherein in the bonding the protective plate, an adhesive is applied to the protective plate such that a space portion is left in a portion of a region surrounding the piezoelectric-element-holding portion, except for a region located on the side toward the flow passage, the protective plate is bonded to the channel substrate, and the space portion is sealed by a material having a water permeability higher than that of the adhesive so as to form a moisture permeable portion through which water within the piezoelectric-element-holding portion permeates.

52. A method of manufacturing a liquid-jet head according to claim 51, wherein the insulating film is formed of an inorganic amorphous material.

* * * * *

UNITED STATES PATENT AND TRADEMARK OFFICE

CERTIFICATE OF CORRECTION

PATENT NO. : 7,559,631 B2
APPLICATION NO. : 10/573356
DATED : July 14, 2009
INVENTOR(S) : Masato Shimada et al.

It is certified that error appears in the above-identified patent and that said Letters Patent is hereby corrected as shown below:

Col. 30 line 58 - Claim 3 : please replace "Pt" with --Ir--.
Col. 30 line 67 - Claim 7 : please replace "Ir" with --Pt--.

Signed and Sealed this

Twenty-ninth Day of September, 2009

David J. Kappos

David J. Kappos
*Director of the United States Patent and Trademark Office*